US011439889B1

(12) United States Patent
Pasic

(10) Patent No.: US 11,439,889 B1
(45) Date of Patent: Sep. 13, 2022

(54) SKATEBOARD WITH INERTIAL ENHANCEMENT

(71) Applicant: Robert Anton Pasic, Vancouver, WA (US)

(72) Inventor: Robert Anton Pasic, Vancouver, WA (US)

( * ) Notice: Subject to any disclaimer, the term of this patent is extended or adjusted under 35 U.S.C. 154(b) by 0 days.

(21) Appl. No.: 17/737,275

(22) Filed: May 5, 2022

(51) Int. Cl.
*A63C 17/26* (2006.01)
*A63C 17/22* (2006.01)
*A63C 17/01* (2006.01)

(52) U.S. Cl.
CPC ..... *A63C 17/26* (2013.01); *A63C 17/012* (2013.01); *A63C 17/015* (2013.01); *A63C 17/223* (2013.01)

(58) Field of Classification Search
CPC ..... A63C 17/26; A63C 17/012; A63C 17/015; A63C 17/223
See application file for complete search history.

(56) References Cited

U.S. PATENT DOCUMENTS 1,503,009 A 7/1924 Savage
2,935,899 A 5/1960 Nallinger
4,181,319 A * 1/1980 Hirbod ..... B62M 1/26 280/11.115
4,861,054 A * 8/1989 Spital ..... A63C 17/015 280/11.115
5,165,710 A * 11/1992 Runyon ..... A63C 17/01 280/217
5,224,719 A * 7/1993 Goodspeed ..... A63C 17/015 280/11.115
5,330,026 A * 7/1994 Hsu ..... A63C 17/12 180/181
5,868,408 A * 2/1999 Miller ..... A63C 17/0046 280/842
6,102,415 A 8/2000 Stewardson
7,635,136 B2 12/2009 Cole
10,766,302 B1 * 9/2020 McInturff ..... A63C 17/012
2006/0032682 A1 * 2/2006 Hillman ..... A63C 17/12 180/65.1
2010/0314851 A1 * 12/2010 Palmer ..... A63C 17/1418 280/87.042
2013/0025955 A1 * 1/2013 Chavand ..... A63C 17/12 180/181
2016/0339328 A1 * 11/2016 Simeray ..... B60L 53/00
2017/0113122 A1 * 4/2017 Ji ..... A63C 17/12
2020/0298096 A1 * 9/2020 Cappello ..... A63C 17/012

* cited by examiner

*Primary Examiner* — Erez Gurari
(74) *Attorney, Agent, or Firm* — Robert Anton Pasic

(57) ABSTRACT

A skateboard truck that includes an inertia drive attached to a wheel. The inertia drive causes an inertial mass (i.e. flywheel) to turn at a higher speed then the wheel. During "pumping" of the skateboard the wheels accelerate and an inertia drive helps propel the skateboard given its inertia combined with the wheel inertia. The inertia drive may be configured to maintain skateboard stability at high speeds.

20 Claims, 27 Drawing Sheets

$N_w$ = WHEEL ROTATIONAL SPEED $N_f$ = FLYWHEEL ROTATIONAL SPEED

R = MECHANICAL DEVICE SPEED RATIO $I_w$ = WHEEL INERTIA $I_f$ = FLYWHEEL INERTIA (a) $R = N_f / N_w$ (b) $I_{total} = I_w + (N_f/N_w)^2 \times I_f$ (c) $I_{total} = I_w + (R)^2 \times I_f$

SKATEBOARD WITH INERTIAL ENHANCEMENT

CROSS-REFERENCE TO RELATED APPLICATIONS

Not applicable

STATEMENT REGARDING FEDERAL SPONSORED RESEARCH OR DEVELOPMENT

Not applicable

NAMES OF PARTIES TO A JOINT RESEARCH AGREEMENT

Not applicable

BACKGROUND

This disclosure relates to skateboard and scooter propulsion and stability. More specifically, the disclosed embodiments relate to skateboard improved and easily changed inertial characteristics.

SUMMARY

The present disclosure provides systems, apparatuses, and methods for propelling and stabilizing skateboards.

In some examples, a device is driven by a skateboard wheel. The device includes an inertial mass, and mechanism which causes the wheel to maintain motion, and orientation. The wheel of the vehicle drives the mechanism causing an inertial mass to rotate about an axis. The device receives energy from the wheel as it is rotated and transfers the received energy to the inertial mass. In other situations the inertial mass transfers energy to the wheel from the inertial mass.

In some examples, a skateboard truck includes a wheel, drive device and an inertial mass. The skateboard includes a drive device configured to rotate the inertial mass at a greater rotational speed than the wheel. The total inertia at the wheel is increased due to the inertial mass and the drive device. The response to "pumping" is enhanced by this added inertia.

In other examples, a skateboard truck includes a wheel and an inertial mass. The skateboard includes a drive device configured to rotate the inertial mass at a greater rotational speed than the wheel. The total inertia at the wheel is increased due to the inertial mass and the drive device. Imperfections in the riding surface (i.e. the ground) tend to push the skateboard wheels causing the skateboard to be unstable at high speeds. The increased total inertia helps to keep the wheels from being directed away from the current direction. This increases the stability of the skateboard at high speeds.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Figure 1:
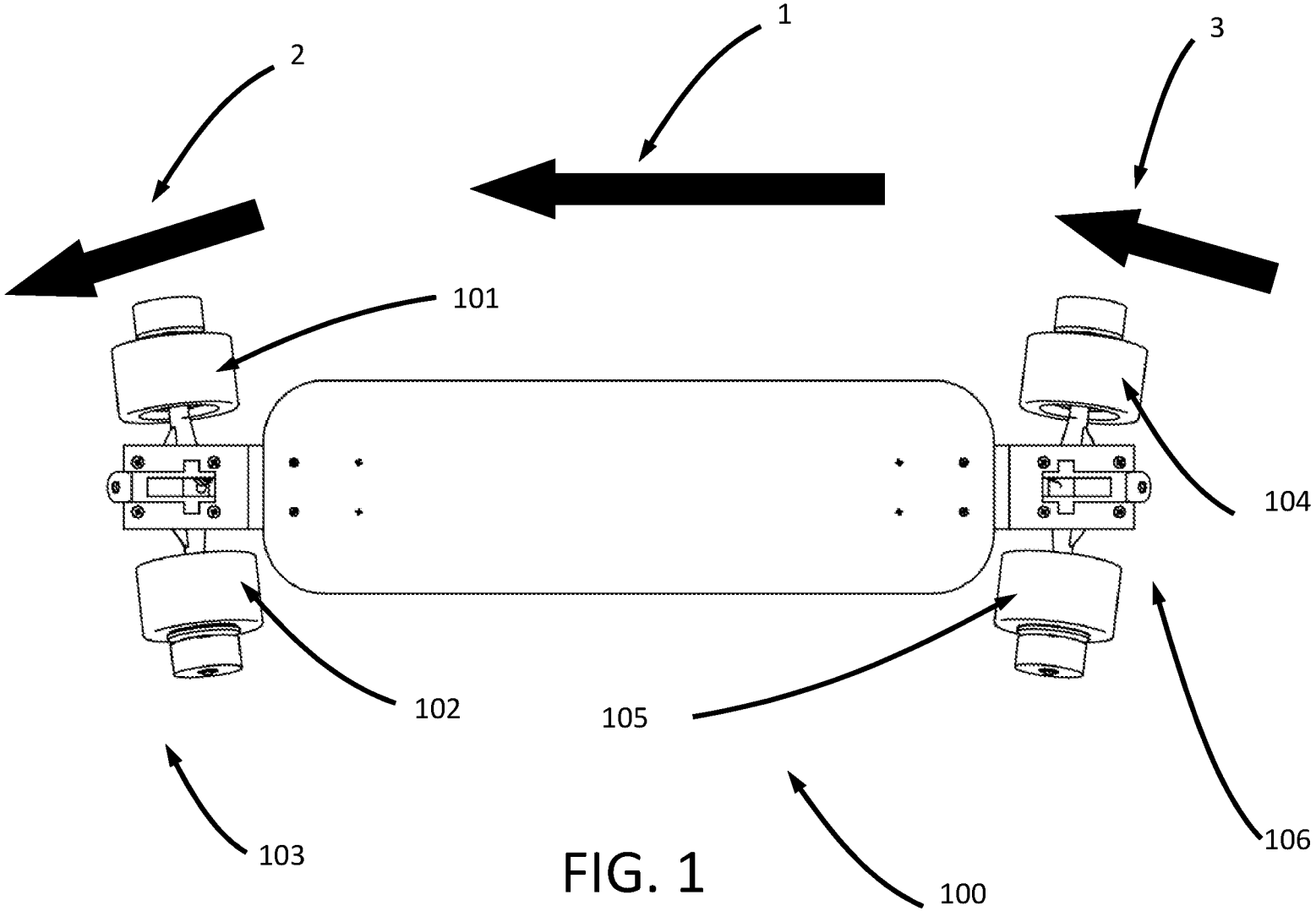
FIG. 1 depicts a top view of a skateboard turning.

Various aspects and examples of an inertial propelled skateboard, as well as related adjustment methods, are described below and illustrated in the associated drawings. Unless otherwise specified, inertia propelled skateboard in accordance with the present teachings, and/or its various components, may contain at least one of the structures, components, functionalities, and/or its variations described, illustrated, and /or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no what intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated. "Comprising," "including," and "having" (and conjugations thereof) are used interchangeably to mean including but not necessarily limited to, and are open-ended terms not intended to exclude additional unrecited elements, or method steps.

Terms such as "first," "second," and "third" are used to distinguish or identify various members of a group, or the like, and are not intended to show serial or numerical limitation.

"AKA" means "also known as," and may be used to indicate an alternative or corresponding term for a given element or elements.

The terms "inboard," "outboard," "forward," "rearward," and the like are intended to be understood in the context of a host vehicle on which systems described herein may be mounted or otherwise attached. For example, "outboard" may indicate a relative position that is laterally farther from the centerline of the vehicle, or a direction that is away from the vehicle centerline. Conversely, "inboard" may indicated a direction toward the centerline, or a relative position that is closer to the centerline. Similarly, "forward" means toward the front portion of the vehicle, and "rearward" means toward the rear of the vehicle. In the absence of a host vehicle, the same directional terms may be used as if the vehicle were present. For example, even when viewed in isolation, a device may have a "forward" edge, based on the fact that the device would be installed with the edge in question facing in the direction of the front portion of the host vehicle.

"Coupled" means connected, either permanently or releasably, whether directly or indirectly through intervening components.

"Resilient" describes a material or structure configured to respond to normal operation loads (e.g. when compressed) by deforming elastically and returning to an original shape or position when unloaded.

"Rigid" describes a material or structure configured to be stiff, non-deformable, or substantially lacking in flexibility under normal operation conditions.

"Elastic" describes a material or structure configured to spontaneously resume is former shape after being stretched or compressed.

"Providing," in the context of a method, may include receiving, obtaining, purchasing, manufacturing, generating, processing, preprocessing, and/or the like, such that the object or material provided is in a state and configuration for other steps to be carried out.

"Operatively," describes a connection between two devices or entities such that a function is provided from one entity to another. For example, a first entity may be operatively connected to a second entity for transferring force. In this example, a connection between first and second entity may be by gears, a belt, solder, or weld such that force (or torque) is provided from first entity to second entity.

"Force," and "torque," in this disclosure includes positive and negative values. For instance, force provided to object one from object two means, object one pushes or pulls on object two and/or object two pushes or pulls on object one.

In this disclosure, one or more publication, patents, and/or patent application may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, the present disclosure pertains to devices and methods for an inertia enhanced skateboard and methods of using the skateboard. In examples described below, a skateboard includes a plurality of wheels. Each wheel is supported by an axle and a truck that is attached to the skateboard at the leading and/or following ends of the skateboard. The wheels contact the ground and an operator is generally positioned on the skateboard opposite the ground.

In some examples the truck includes a rotating inertial mass that rotates as the wheel rotates. The speed at which the inertial mass rotates is determined by the speed of the skateboard and mechanisms included in the truck and/or the wheel.

In some examples, the truck and/or wheel includes a mechanism that drives the inertial mass at an increased speed. In these examples, the mechanism may be any drive system such as meshing gears, belt and pulley drives, or friction drives. By driving the inertial mass at a greater speed than the wheel, the inertia mass increases the inertia experienced at the wheel. This is because the inertia acting at the wheel by of the inertial mass is multiplied by the speed increase ratio squared.

In some examples the truck includes a mechanism that directly connects the wheel to the inertial mass. In these examples, the inertia at the wheel comprises the wheel inertia and the inertia of the inertial mass.

To understand some of the examples, a brief discussion of the dynamics of a skateboard may be helpful.

In order to maintain or increase speed of a skateboard an operator may resort to a method called "pumping". Pumping is the act of turning the skateboard left and right as it translates along a generally forward path. During pumping, the turned wheels accelerate as the mass of the operator drives the skateboard in a generally forward direction. The wheels accelerate because they are traveling a longer distance than the operator. As the operator turns the skateboard in the opposite direction the wheels try to pull the rider at the increased wheel speed. This causes the rider to accelerate and the wheel to decelerate. The amount of acceleration and deceleration is determined by the total wheel inertia and the mass of the operator.

Figure 2:
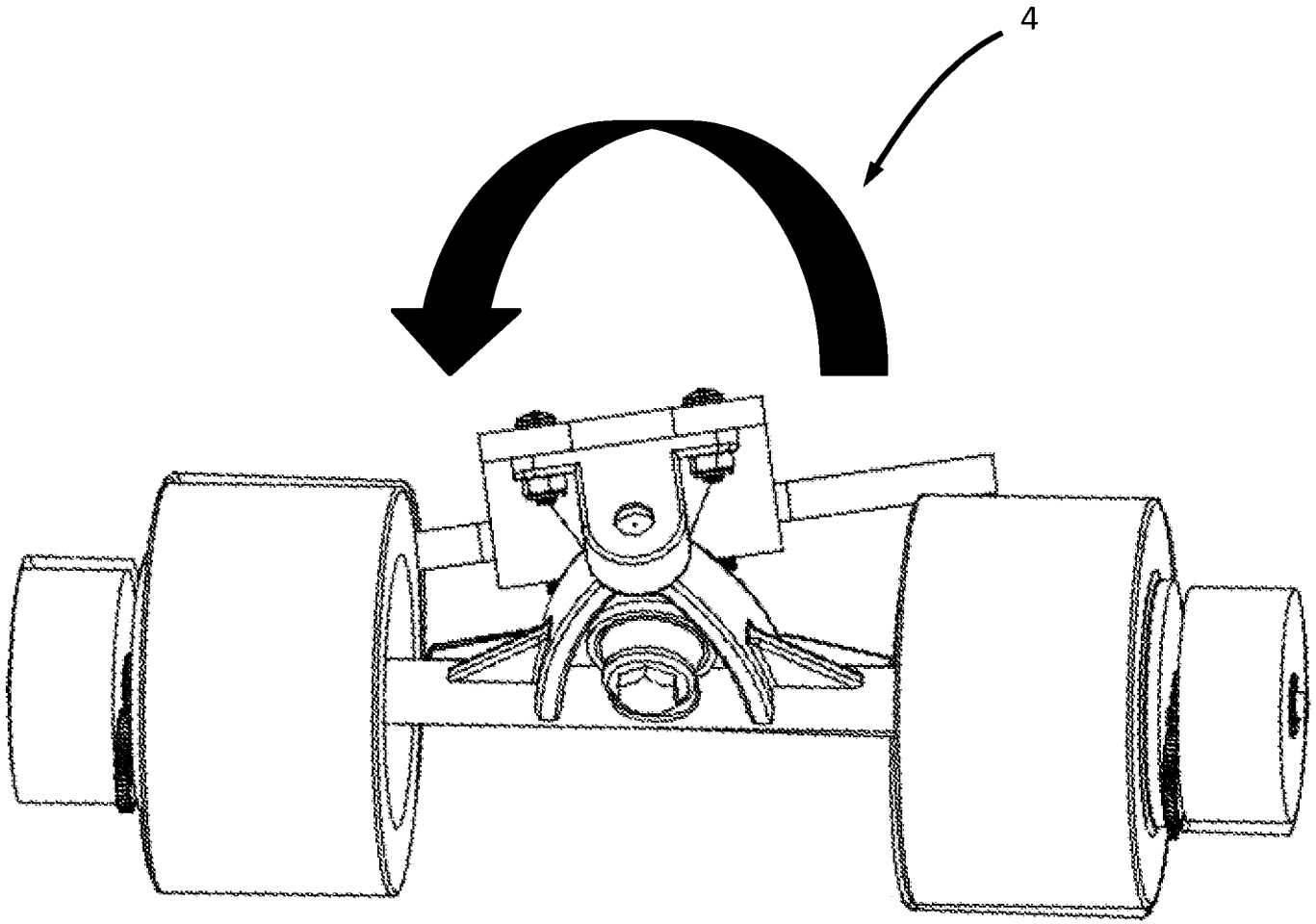
FIG. 2 depicts a front view of a skateboard turning showing tilting of the board.

FIG. 1 depicts an example of a turning skateboard 100. The skateboard has movement in the direction of travel 1. This movement establishes the direction of momentum in direction 1. Tilting the board about direction 1 as depicted in FIG. 2 by rotational arrow 4, causes the wheels 101 and 102 on the leading truck 103 to turn in the direction 2 and the wheels 104 and 105 on the following truck 106 to turn in the direction 3. Since the direction of travel of wheels 101 and 102 is not the same as direction 1, wheels 101 and 102 accelerate to keep pace with the skateboard momentum in direction 1. This acceleration is caused by the skateboard (including an operator) having greater inertia than the wheels. As the operator tilts the board toward the opposite direction wheels 101 and 102, having a greater speed, tend to propel the skateboard 100 (and operator) forward in direction 1. By turning repeatedly, back and forth the wheel speeds are increased and propel skateboard 100 forward in direction 1.

The inertia of wheels 101, 102, 104, and 105 has the effect of increasing the propulsion of the skateboard 100 during each "pumping" cycle. The amount of propulsion depends on the relative inertia of wheels 101, 102, 104, and 105, and the operator (and skateboard 100). By increasing the wheel inertia the operator can be propelled at an increasing speed. The wheel inertia may be increased by adding weight or by driving an inertia drive device that drives a weight.

However, increasing weight of the skateboard 100 may have other undesired effects. For instance more energy is needed to maintain speed if skateboard 100 has a great amount of weight. Additionally, a heavier skateboard is harder to carry when not in use.

Figure 3:
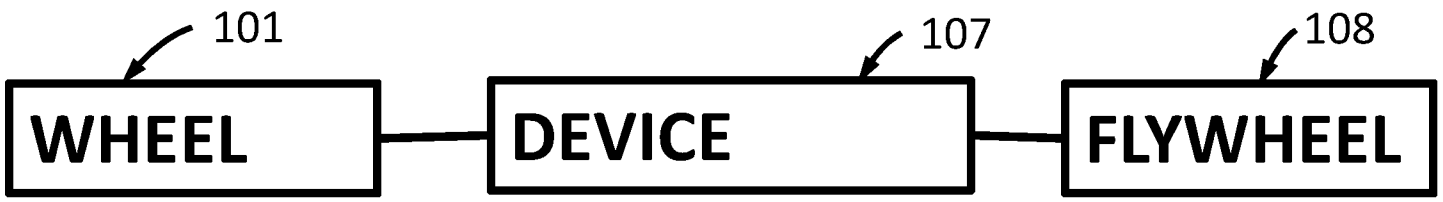
FIG. 3 depicts a schematic of a wheel and flywheel connected by an inertial drive device, additionally equations are included for calculating the flywheel and wheel inertia combination.

In order to keep the weight of the skateboard low while still increasing the wheel inertia, a device may be used. The device may be configured to increase the rotational speed of an additional weight. This weight may be referred to as a flywheel or inertial mass. FIG. 3 depicts a device 107 that provides wheel energy to a flywheel 108. Given the wheel 101 rotational speed $N_w$, the flywheel 108 rotational speed $N_f$, the wheel inertia $I_w$, and the flywheel inertia $I_f$ the total inertia at the wheel $I_{total}$ is shown in equation b) of FIG. 1. The inertia of the flywheel $I_f$ is multiplied by the square of the ratio R given in equation a) of FIG. 1. Namely, the ratio of the flywheel rotational speed $N_f$ divided by the wheel rotational speed $N_w$. Equation c) of FIG. 1 shows the total inertia at the wheel as $I_{total}$.

Examples, Components, and Alternatives

The following sections describe selected aspects of illustrative inertia enhanced skateboards, as well as related systems and/or methods. The examples in these sections are intended for illustration and should not be interpreted as limiting the scope of the present disclosure. Each section may include one or more distinct embodiments or examples, and/or contextual or related information, function, and/or structure.

A: Illustrative Outboard Inertia Enhanced Skateboard

Figure 4:
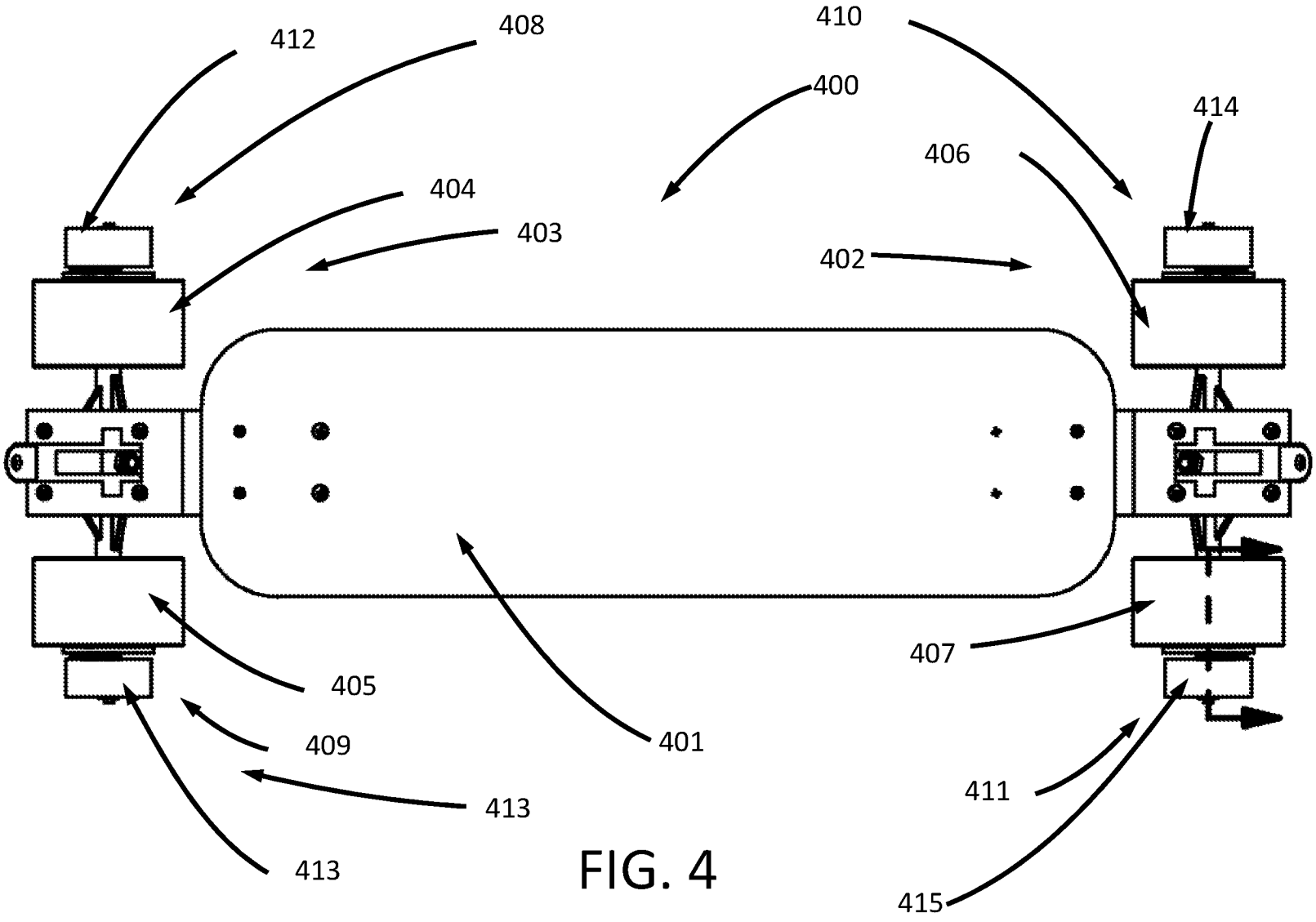
FIG. 4 depicts a top view of an illustrative outboard inertia enhanced skateboard.
Figure 5:
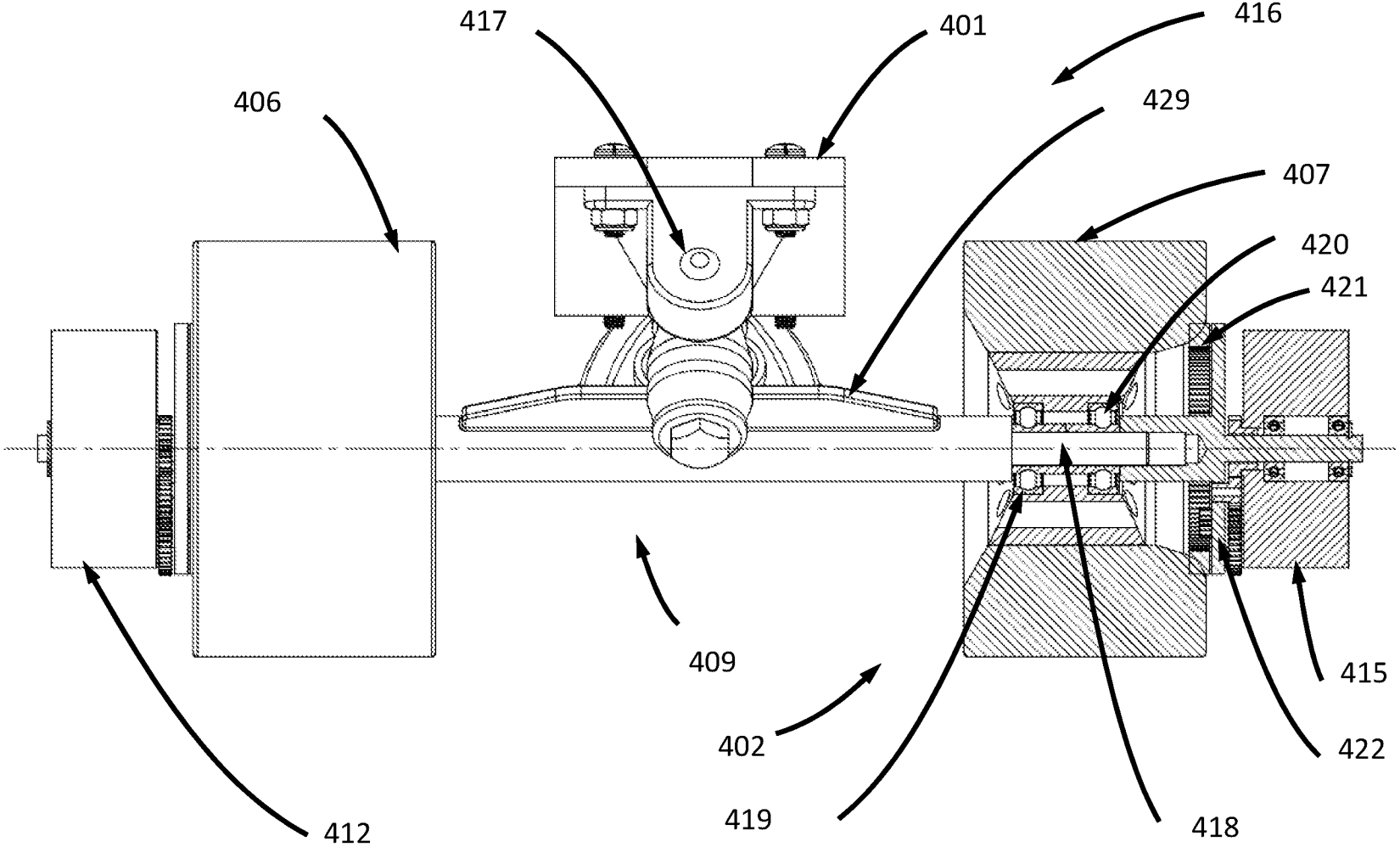
FIG. 5 depicts a partial cross sectional view shown in FIG. 4.
Figure 6:
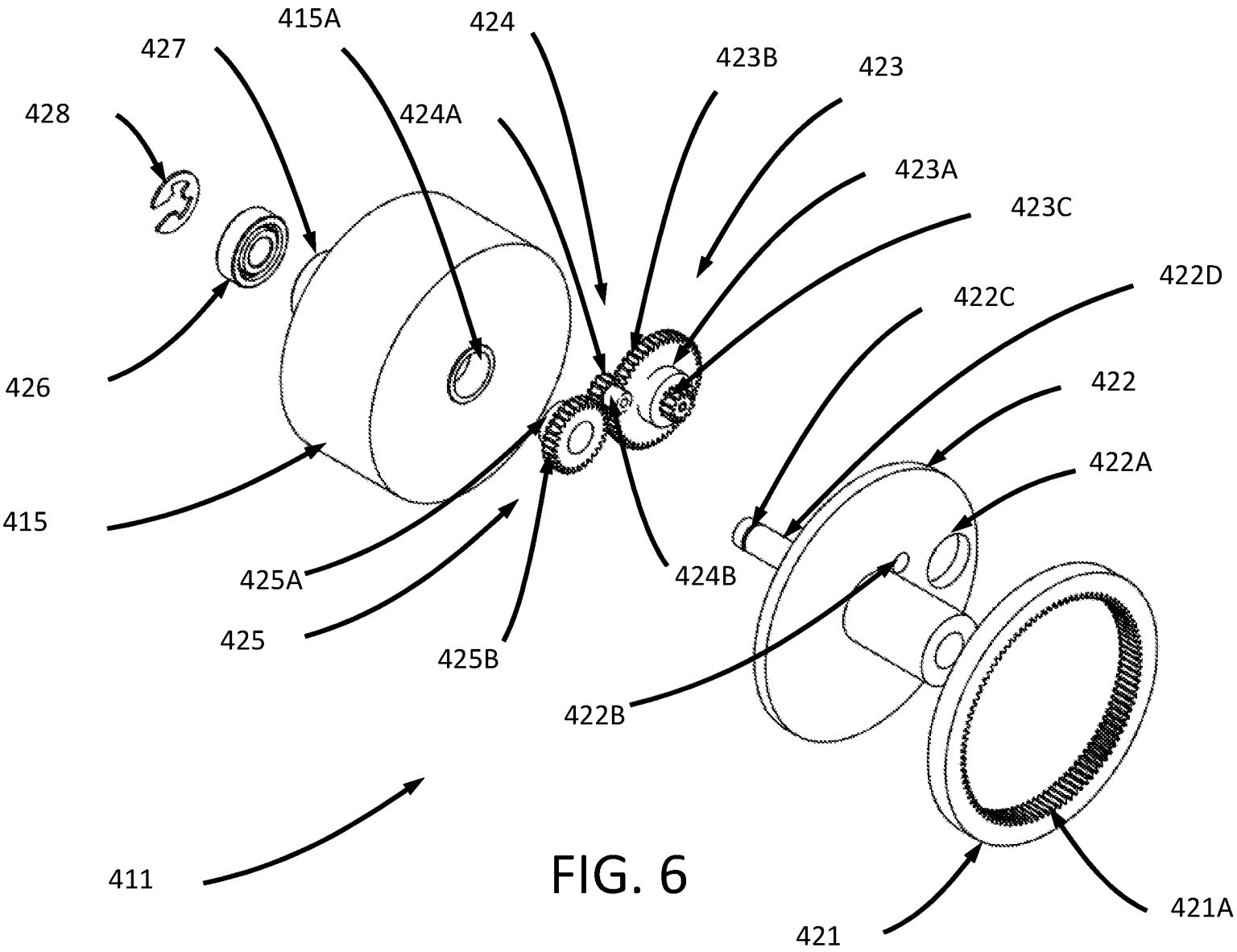
FIG. 6 depicts a partial exploded isometric of inertial drive device of the skateboard of FIG. 4

As shown in FIGS. 4-6, this section describes an inertia enhanced skateboard 400. Skateboard 400 is an example of skateboard 100 described in the Overview. FIG. 4 is a top view of the skateboard 400 showing the location of a partial section view of the skateboard truck 402. FIG. 5 is the section view located in FIG. 4. FIG. 6 is an exploded view of the inertia drive device 411 of skateboard 400.

Skateboard 400 is a four wheeled skateboard with a leading truck 403 and a following truck 402 that turn the wheels 404, 405, 406, and 407 as the board 401 is tilted. In this example, each inertia drive devices 408, 409, 410, and 411 are depicted outboard of each of wheels 404, 405, 406, and 407. The inertia drive devices 408, 409, 410, and 411 transfer the energy to and from the wheels 404, 405, 406, and 407 and flywheels 412, 413, 414, and 415 respectively. The inertia drive device 411 may include a gear train that drives the flywheel 415 at a rotational speed that is greater than the rotational speed of the wheel 407.

Referring to FIGS. 5 and 6, the truck 416 is attached to the board 401. Truck 416 includes a tilt-to-turn assembly 417 that causes hanger 429 to turn wheels 406 and 407 in the same direction as board 401 is tilted. Axle 418 is rigidly attached to hanger 429 and supports bearings 419 and 420. These bearings 419 and 420 in turn support wheel 407 and provide rotation of wheel 407 relative to axle 418. Attached to the wheel 407 is a ring gear 421. Ring gear 421 rotates with the wheel 407.

Drive support 422 may be rigidly attached to the end of axle 418. In this example, the attachment of drive support 422 to axle 418 is a threaded connection; however any manner of connecting axle 418 to drive support 422 may be used. For example, the axle 418 and drive support 422 could be welded, riveted, brazed, press fit, or pinned.

FIG. 6 depicts an isometric exploded view of inertia drive device 411. Ring gear 421 includes teeth 421A which mesh with input teeth 423C of a cluster gear 423. Cluster gear 423 includes a shoulder 423A which engages the cluster gear bore 422A located on drive support 422. Cluster gear bore 422A allows cluster gear 423 to rotate and mesh cluster gear input teeth 423C with ring gear teeth 421A. Cluster gear output teeth 423B mesh with idler gear teeth 424A located on the periphery of idler gear 424. Idler gear 424 is supported at idler shoulder 424B by idler bore 422B of drive support 422. Further, idler gear teeth 424A mesh with output gear teeth 425B located on output gear 425. Output gear 425 is rigidly attached to flywheel 415. Output shoulder 425A may be pressed, welded, brazed, pinned, or threaded into the flywheel bore 415A. Flywheel 415 is rotationally supported by drive support shaft 422D located on drive support 422. Drive support 422 and wheel 407 are supported by axle 418. This causes the flywheel 415 and wheel 407 to maintain their relative location to each other. In some examples, bearings 426 and 427 may be inserted into the flywheel bore 415A and onto drive support shaft 422D. Additionally, a retainer 428 may be used to retain flywheel 415 to drive support shaft 422D by engaging drive support shaft groove 422C located on drive support shaft 422D.

In some examples, ring gear 421 includes 100 teeth 421A, cluster gear input teeth 423C includes 12 teeth, cluster gear output teeth 423B includes 40 teeth, idler gear teeth 424A includes 12 teeth, and the output gear 425 includes 30 teeth 425B. In this example, the inertia drive 411 drives flywheel 415 eleven (11) times faster than wheel 407. The total inertia at wheel 407 exerted by flywheel 415 and wheel 407 is determined below:

$$I_{total}=I_w+(11)^2\times I_f$$

Figure 7:
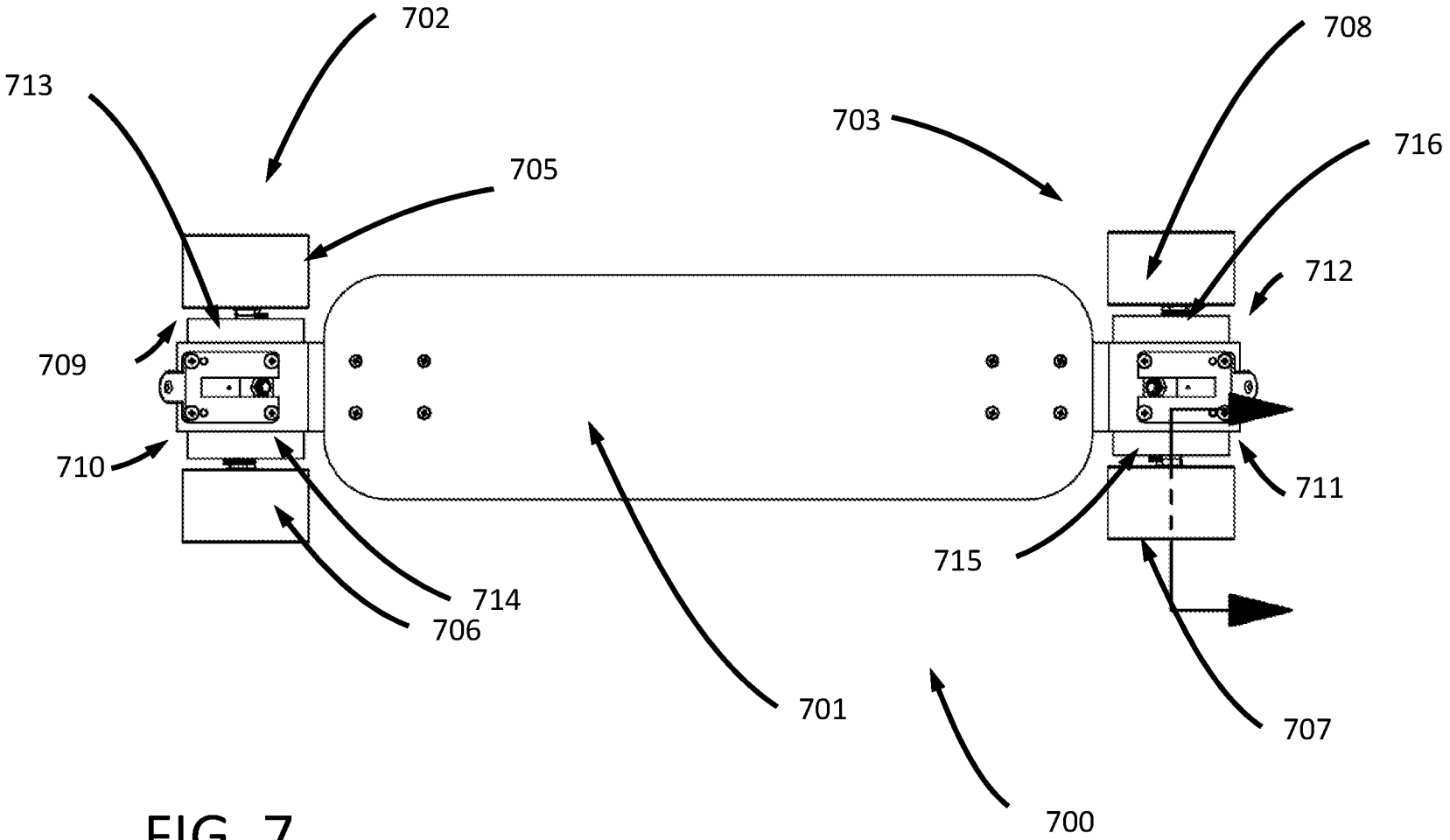
FIG. 7 depicts a top view of an illustrative inboard inertia enhanced skateboard.
Figure 8:
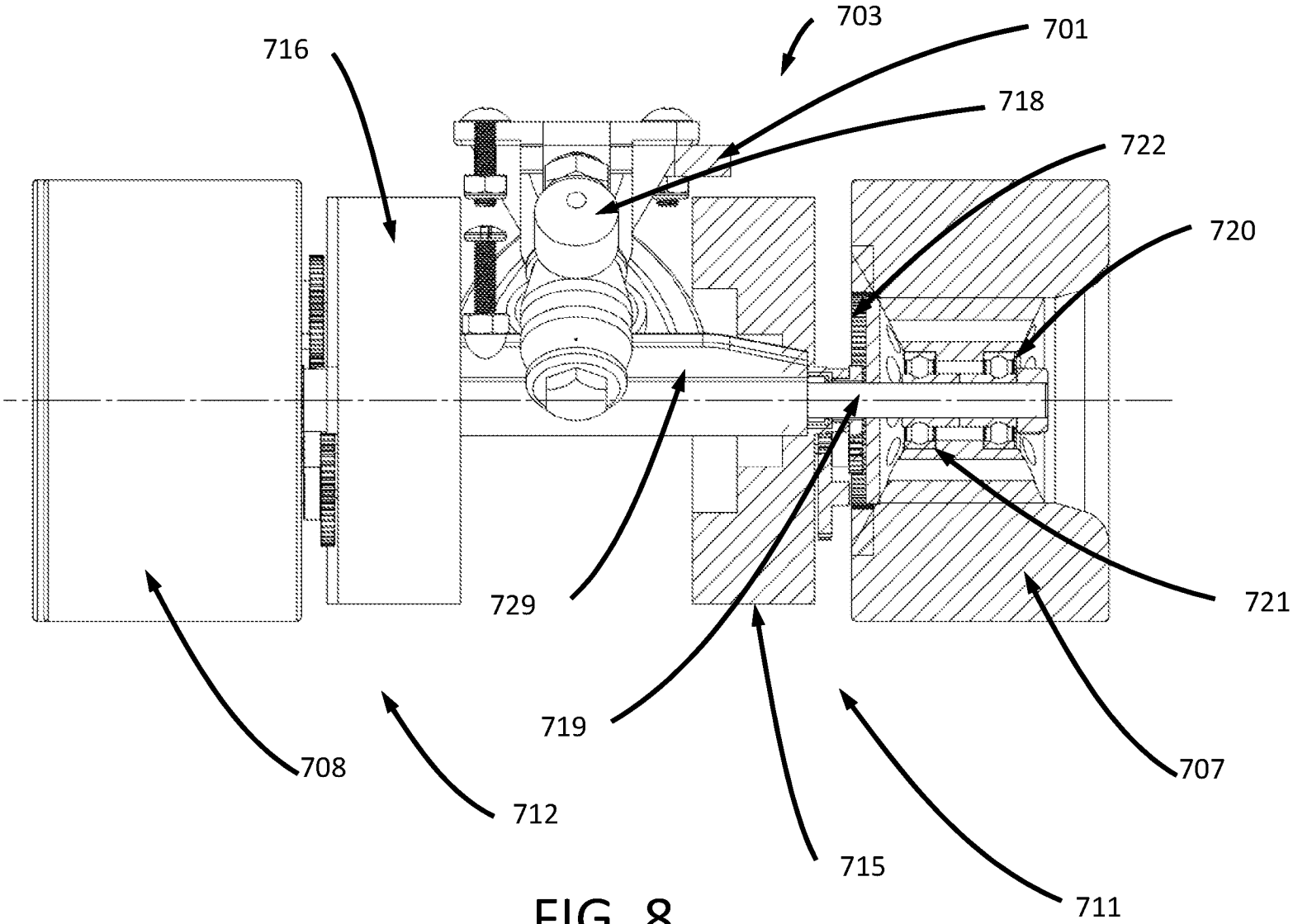
FIG. 8 depicts a partial section view shown in FIG. 7.
Figure 9:
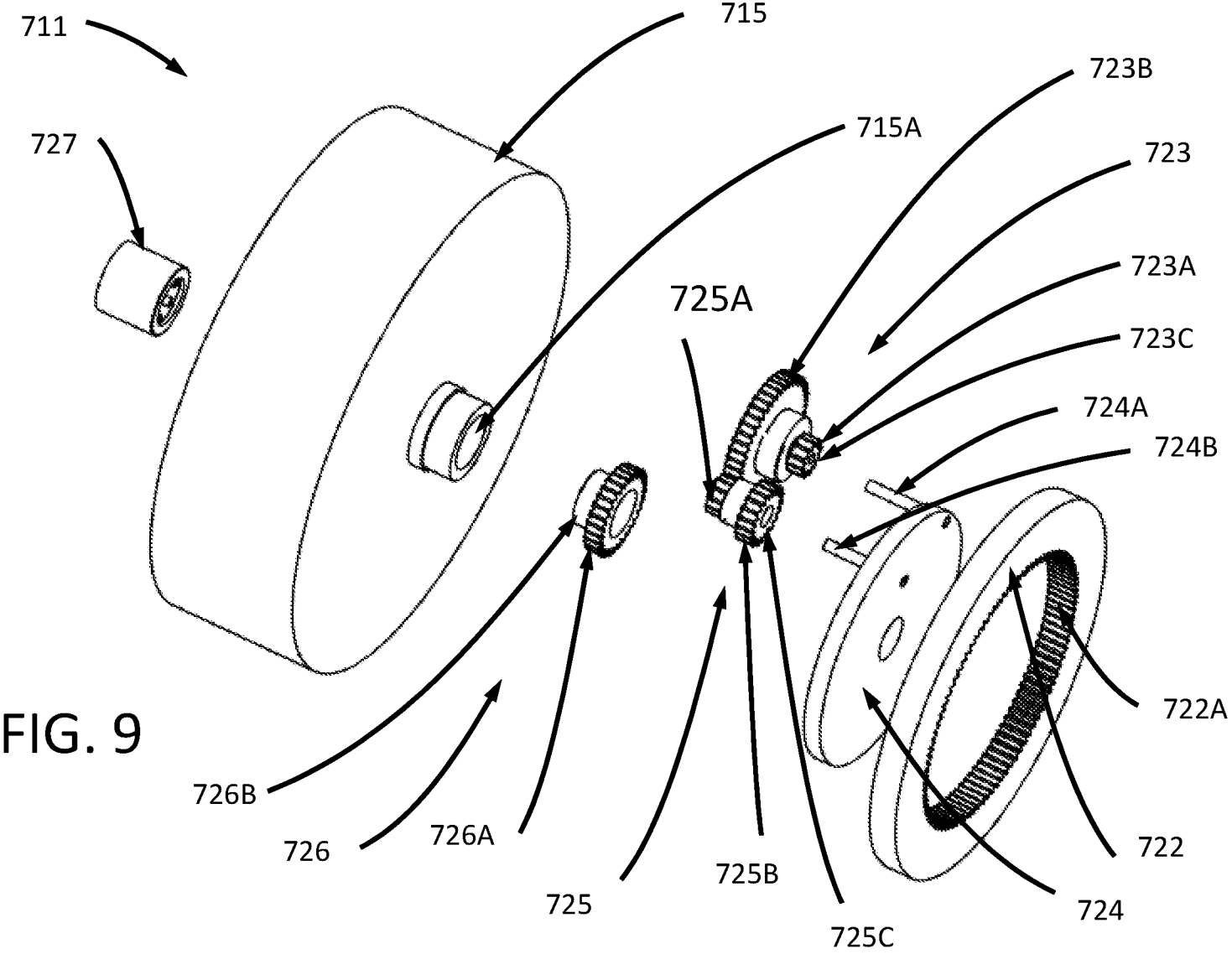
FIG. 9 depicts a partial exploded isometric of an illustrative inboard inertia enhanced skateboard (wheel 707 not shown).

Where:

$I_{total}$ is the total inertia at wheel 404D not including the inertia of the gears $I_w$ is the inertia of the wheel 404D $I_f$ is the inertia of the flywheel 406C B: Illustrative Inboard Inertia Enhanced Skateboard FIGS. 7-9, depict an example of an inertia enhanced skateboard 700. FIG. 7 is a top view of the skateboard 700 showing the location of a section view of the skateboard truck 701. FIG. 8 is the section view located in FIG. 7. FIG. 9 is a partial exploded view of the flywheel drive system 711 of skateboard 700.

Skateboard 700 is a four wheeled skateboard having a leading truck 702 and a following truck 703 that turn the wheels 705, 706, 707, and 708 as the board 701 is tilted. In this example, each inertia drive device 709, 710, 711, and 712 is depicted inboard of each of the wheels 705, 706, 707, and 708. The inertia drive devices 709, 710, 711, and 712 transfer the energy to and from the wheels 705, 706, 707, and 708 and drive flywheels 713, 714, 715, and 716 respectively. The inertia drive device 711 includes a gear train that drives the flywheel 715 at a rotational speed that is greater than the rotational speed of the wheel 707.

Referring to FIGS. 8 and 9, the following truck 703 is attached to the board 701. Truck 703 includes a tilt-to-turn assembly 718 that causes hanger 729 to turn wheels 708 and 707 as the board 701 is tilted. Axle 719 is rigidly attached to hanger 729 and supports bearings 720 and 721. Bearings 720 and 721 support wheel 707 and allows rotation relative to the axle 719. Attached to wheel 707 is ring gear 722. Ring gear 722 rotates with wheel 707.

FIG. 9 depicts the inertia drive device 711. Ring gear 722 includes teeth 722A which mesh with teeth 723A of cluster gear 723. Cluster gear 723 includes a bore 723C which engages the cluster gear shaft 724A located on drive support 724. Cluster gear bore 723C allows cluster gear 723 to rotate and mesh cluster gear input teeth 723A with the ring gear teeth 722A. Cluster gear teeth 723B mesh with idler cluster gear teeth 725A located on idler gear 725. Idler cluster gear 725 is supported at idler bore 725C by idler shaft 724B of drive support 724. Further, idler cluster gear output teeth 725B mesh with the output gear teeth 726A located on output gear 726. Output gear 726 is rigidly attached to flywheel 715 by engaging output shoulder 726A into the flywheel bore 715A. This engagement may include pressing, welding, brazing, pinning, or threading. Flywheel 715 is rotationally supported by axle 719 (shown in FIG. 8). In some examples, bearing 727 may be inserted into the flywheel bore 715A and onto axle 719. Bearing 727 supports flywheel 715 on axle 719. This causes the flywheel 715 and wheel 707 to maintain their relative location to each other.

In some examples, ring gear 722 includes 100 teeth 722A, cluster gear input teeth 723A includes 20 teeth, cluster gear output teeth 723B includes 45 teeth, idler cluster gear input teeth 725A includes 20 teeth, and the cluster gear output teeth includes 20 teeth and the output gear teeth include 30 teeth. The combination drives flywheel 715 seven and a half (7.5) times faster than wheel 707. This example results in the inertia at wheel 707 exerted by flywheel 715 is determined below:

$$I_{total}=I_w+(7.5)^2\times I_f$$

Where:

$I_{total}$ is the total inertia at wheel 707 not including the inertia of the gears $I_w$ is the inertia of the wheel 707

$I_f$ is the inertia of the flywheel 715

C: Illustrative Belt Driven Inertia Enhanced Skateboard

Figure 10:
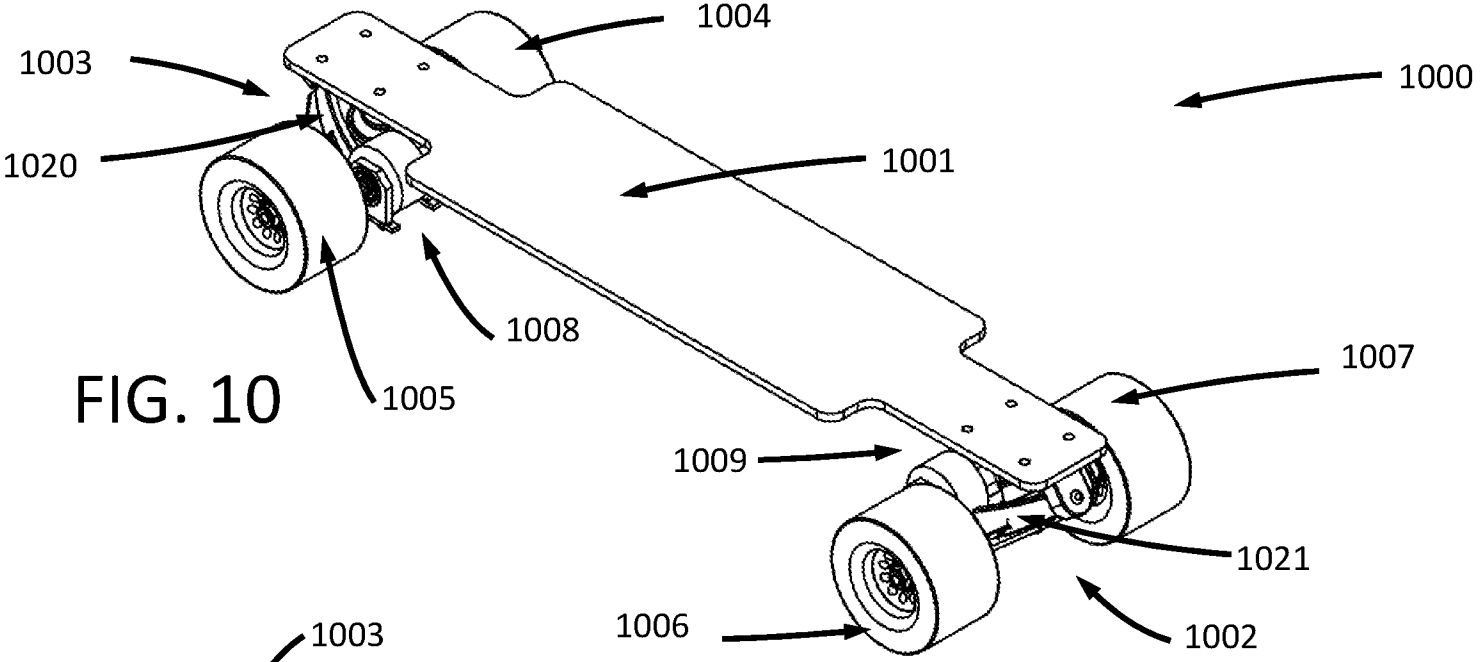
FIG. 10 depicts a partial isometric of an illustrative belt driven inertia enhanced skateboard.
Figure 11:
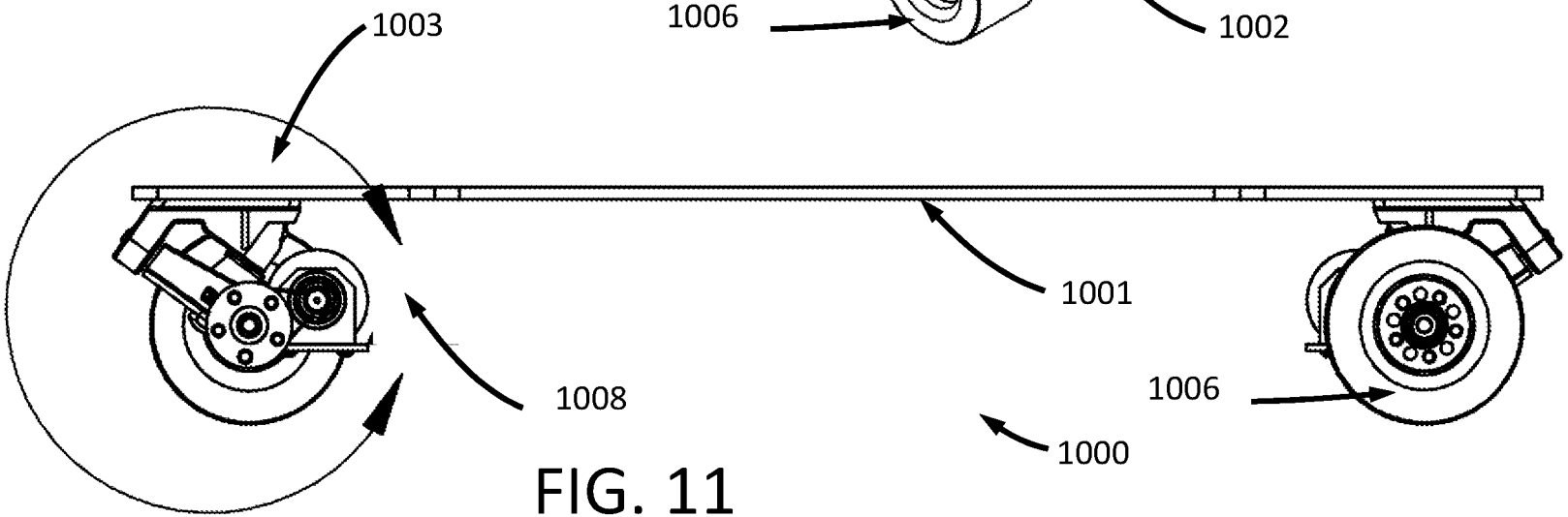
FIG. 11 depicts a side view of the skateboard of FIG. 10 with wheel 1005 removed.
Figure 12:
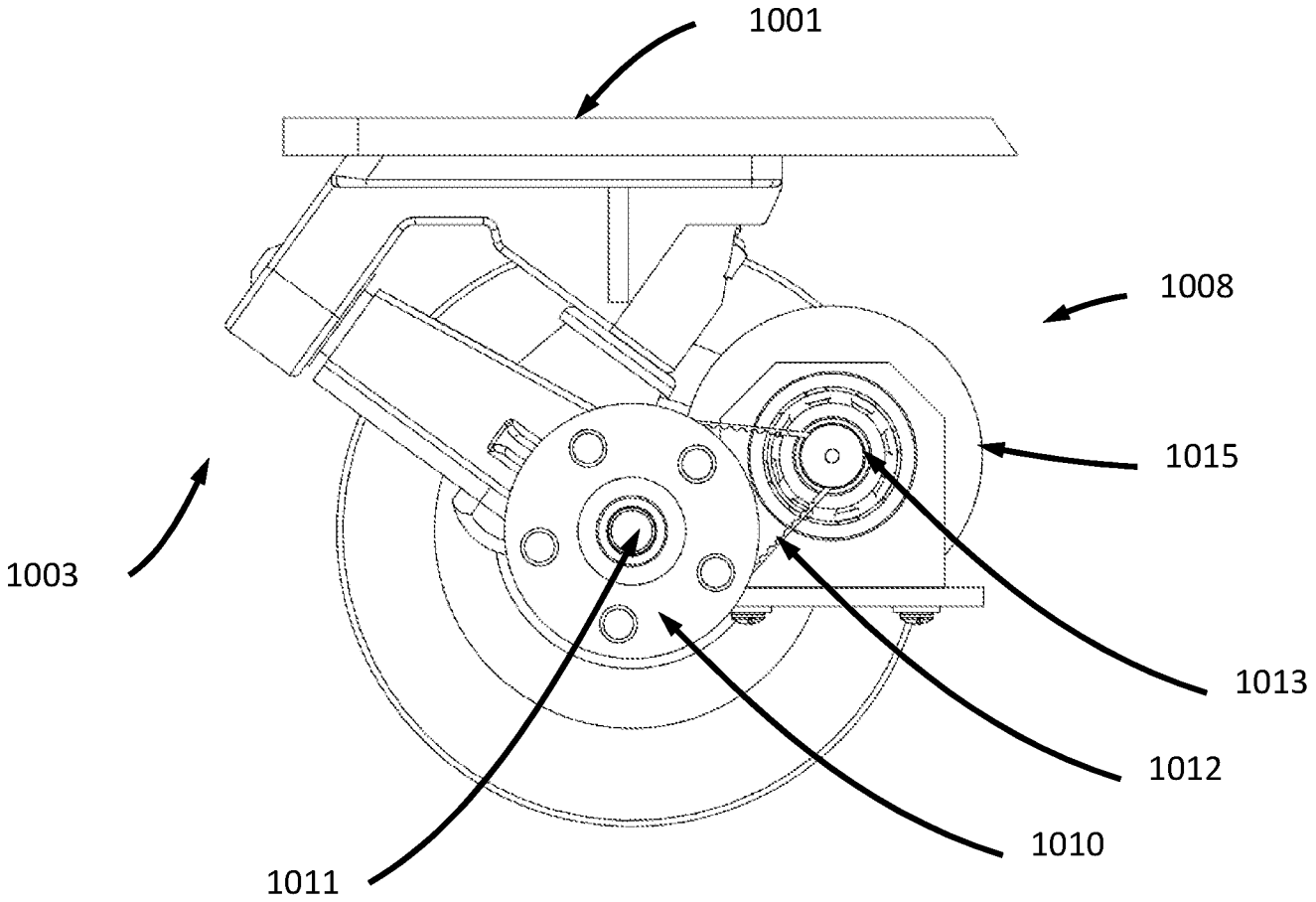
FIG. 12 depicts a detail view shown in FIG. 11.

FIGS. 10-12 depict an illustrative belt driven inertia enhanced skateboard 1000. Leading truck 1002 and following truck 1003 are located at each end of the board 1001. Tilting the board 1001 causes leading truck 1002 and following truck 1003 to turn hangers 1020 and 1021 which supports wheels 1006 and wheel 1007 of the leading truck 1002 and wheel 1004 and wheel 1005 of the following truck 1003. In this example, an inertia drive device is operatively coupled to each wheel. Examples of these inertia drive devices 1008 and 1009 are depicted in FIG. 10.

FIG. 11 depicts a side view of an illustrative belt driven enhanced skateboard 1000 with the wheel 1005 removed. FIG. 12 depicts an enlarged view of the detail shown in FIG. 11. Drive pulley 1010 is attached to wheel 1005 such that wheel 1005 and drive pulley 1010 rotate about axle 1011. Drive belt 1012 is operatively engaged with flywheel pulley 1013 and drive pulley 1010 such that rotation of drive pulley 1010 causes rotation of flywheel pulley 1013. Flywheel pulley 1013 causes flywheel 1015 to rotate.

Figure 13:
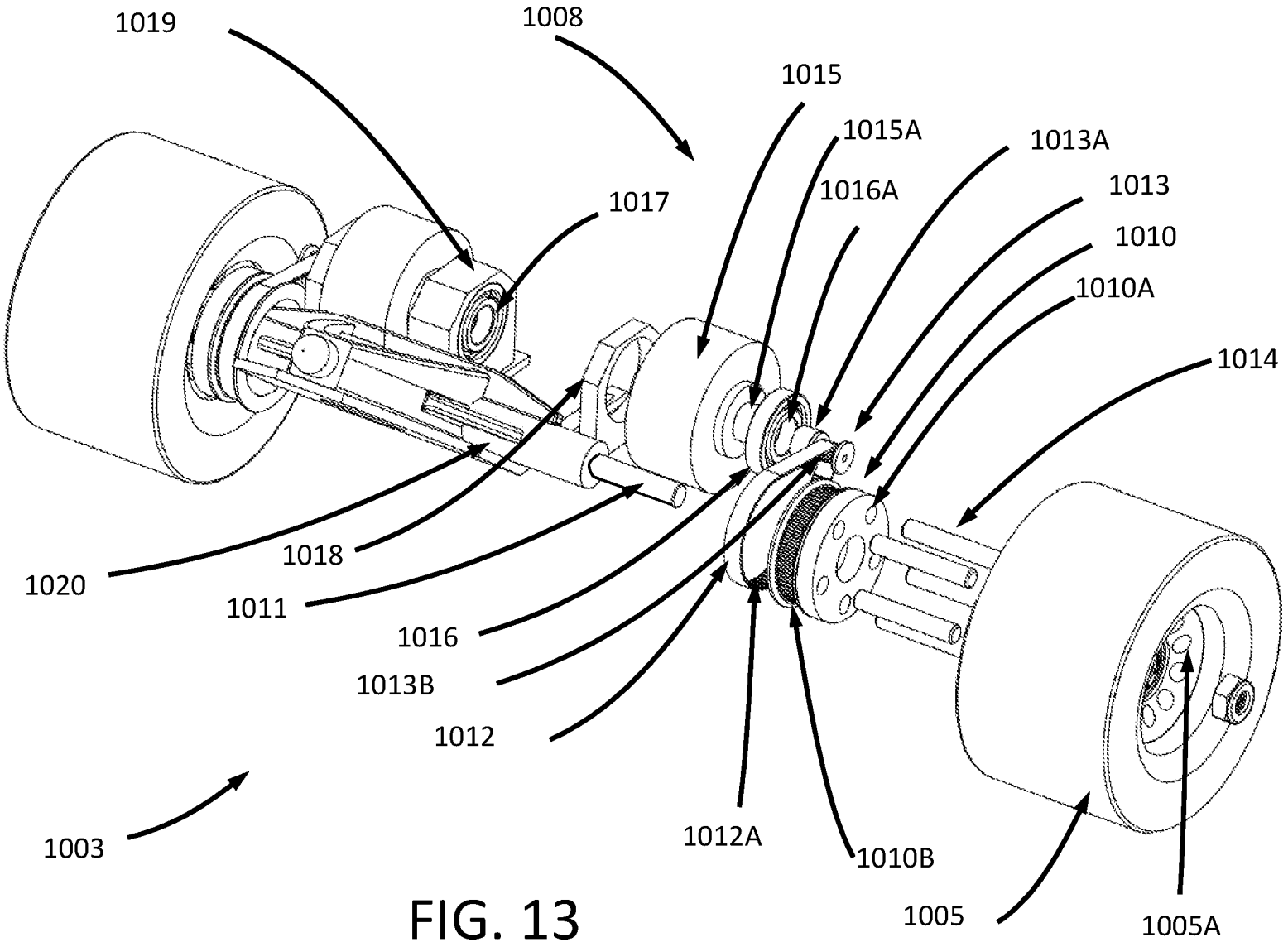
FIG. 13 depicts a partial exploded isometric view of the inertial drive device of an illustrative belt driven inertia enhanced skateboard.
Figure 14:
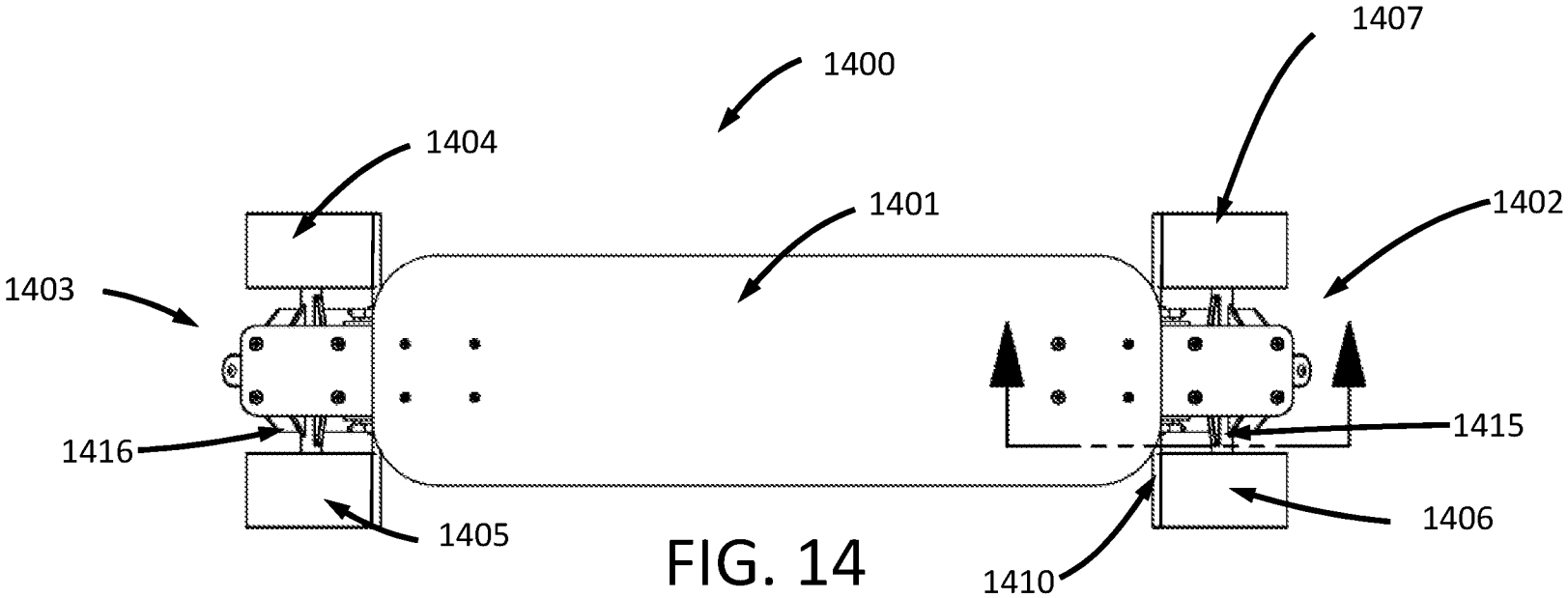
FIG. 14 depicts a top view of an inertia enhanced skateboard with a friction drive.

FIG. 13 depicts an exploded isometric view of an illustrative belt driven enhanced skateboard inertia drive device 1008. Wheel 1005 may be attached to drive pulley 1010 by pins 1014 which are inserted into drive pulley holes 1010A in drive pulley 1010. Pins 1014 are also inserted into the wheel holes 1005A. Although this example includes pins 1014 for attaching drive pulley 1010 to wheel 1005 any method of attachment of drive pulley 1010 to wheel 1005 that allows wheel 1005 to secure drive pulley 1010 to wheel 1005 will suffice. For instance wheel 1005 may include drive pulley 1010 features that engage drive belt 1012 and eliminate the need for attachment of drive pulley 1010 as it may be an integral feature of wheel 1005.

In some examples, drive pulley 1010 features may include drive pulley teeth 1010B located on the periphery of drive pulley 1010. Drive pulley teeth 1010B may engage drive belt 1012 by engaging drive belt teeth 1012A. Drive belt teeth 1012A may also engage flywheel pulley teeth 1013B located on the periphery of flywheel pulley 1013. Flywheel pulley 1013 is attached to flywheel 1015 using a flywheel pulley shoulder 1013A. Flywheel 1015 is supported by first bearing 1016 and second bearing 1017 at flywheel shoulder 1015A and a similar flywheel shoulder (not shown) on flywheel 1015. First bearing 1016 and second bearing 1017 are supported on hanger 1020 by first bearing support 1018 and second bearing support 1019.

Hanger 1020 may be an integral part of axle 1011. In some examples, the hanger 1020 moves with axle 1011 during a turn. This causes the flywheel 1015 and wheel 1005 to maintain their relative location to each other.

In this example, drive pulley teeth 1010B include 60 teeth and flywheel pulley teeth 1013B include 10 teeth. This combination of pulley teeth result in flywheel 1013 rotating at six (6) times the speed of drive pulley 1010. In this example, the total inertia at wheel 1005 not including the mass of drive pulley 1010 and flywheel pulley 1013 is determined below:

$$I_{total}=I_w+(6)^2\times I_f$$

Where:

$I_{total}$ is the total inertia at wheel 1005 not including the inertia of the pulleys $I_w$ is the inertia of the wheel 1005

$I_f$ is the inertia of the flywheel 1015

D: Illustrative Friction Driven Inertia Enhanced Skateboard

Figure 15:
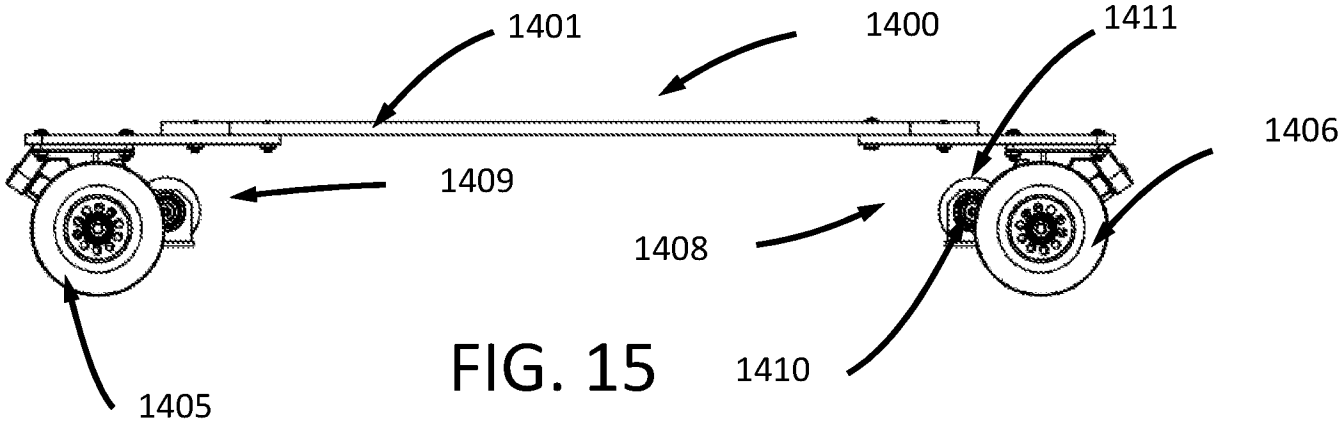
FIG. 15 depicts a side view of the skateboard of depicted in FIG. 14.

FIGS. 14-17 depict an illustrative friction driven inertia enhanced skateboard 1400. Leading truck 1402 and following truck 1403 are located at each end of the board 1401. Tilting the board 1401 causes leading truck 1402 and following truck 1403 to turn hanger 1415 causing wheels 1406 and wheel 1407 of the leading truck 1402 and hanger 1416 causing wheels 1404 and wheel 1405 of the following truck 1403 to turn. In this example, an inertia drive device is operatively coupled to each wheel. Examples of these inertia drive devices 1408 and 1409 are illustrated in FIG. 15.

Figure 16:
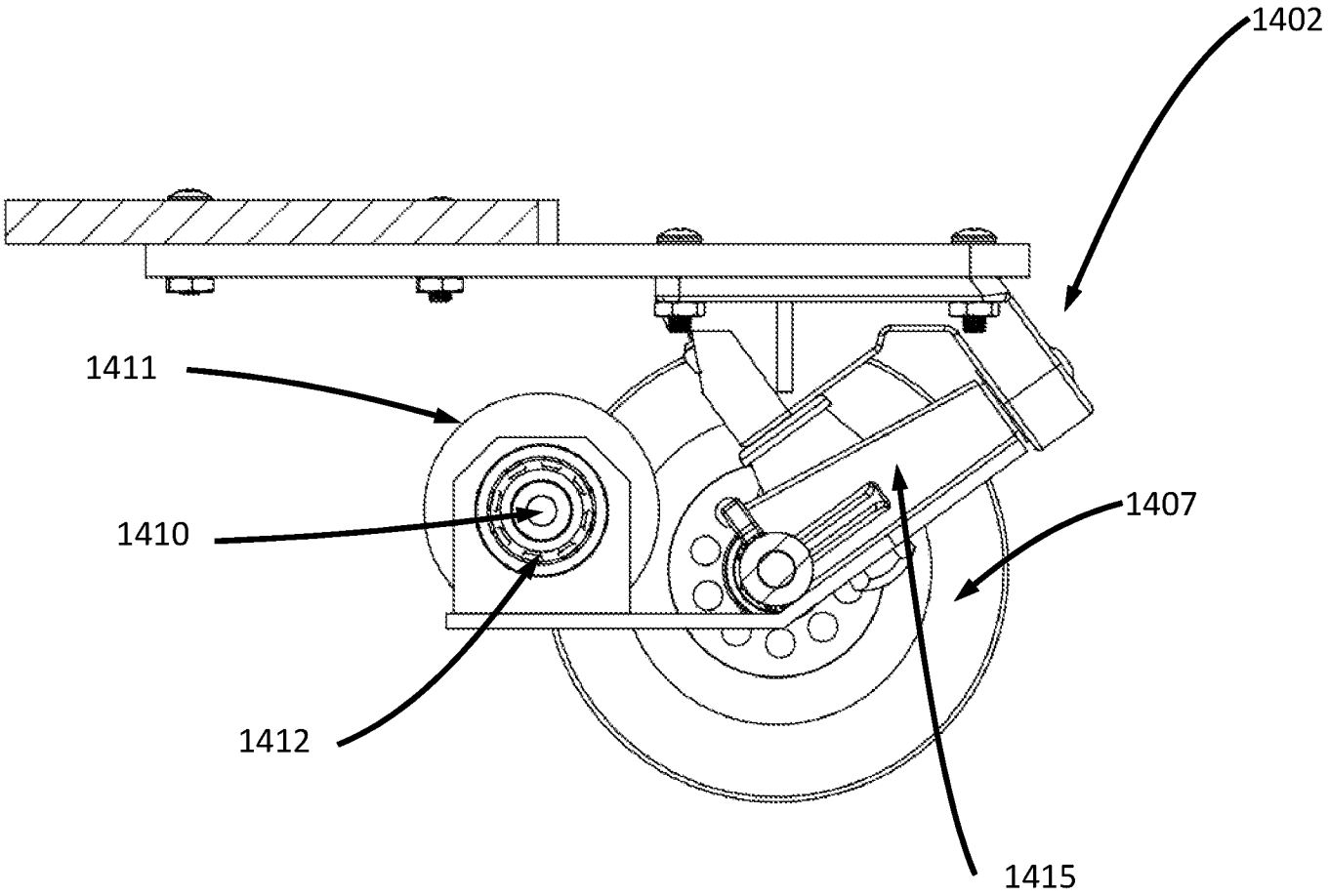
Fig. 16 depicts a cross sectional view shown in FIG. 14.

FIG. 15 depicts a side view of an illustrative friction driven enhanced skateboard 1400. Wheel 1406 is in contact with flywheel shaft 1410, causing flywheel shaft 1410 to rotate in response to rotation of wheel 1406. Rotation of flywheel shaft 1410 causes flywheel 1411 to rotate. FIG. 16 depicts a section view located in FIG. 14. Flywheel shaft 1410 is supported in bearing 1412 which in turn is supported by hanger 1415. Flywheel 1411, being supported by hanger 1415, moves with hanger 1415 during tilting of board 1401. This causes the flywheel 1411 and wheel 1407 to maintain their relative location to each other.

Figure 17:
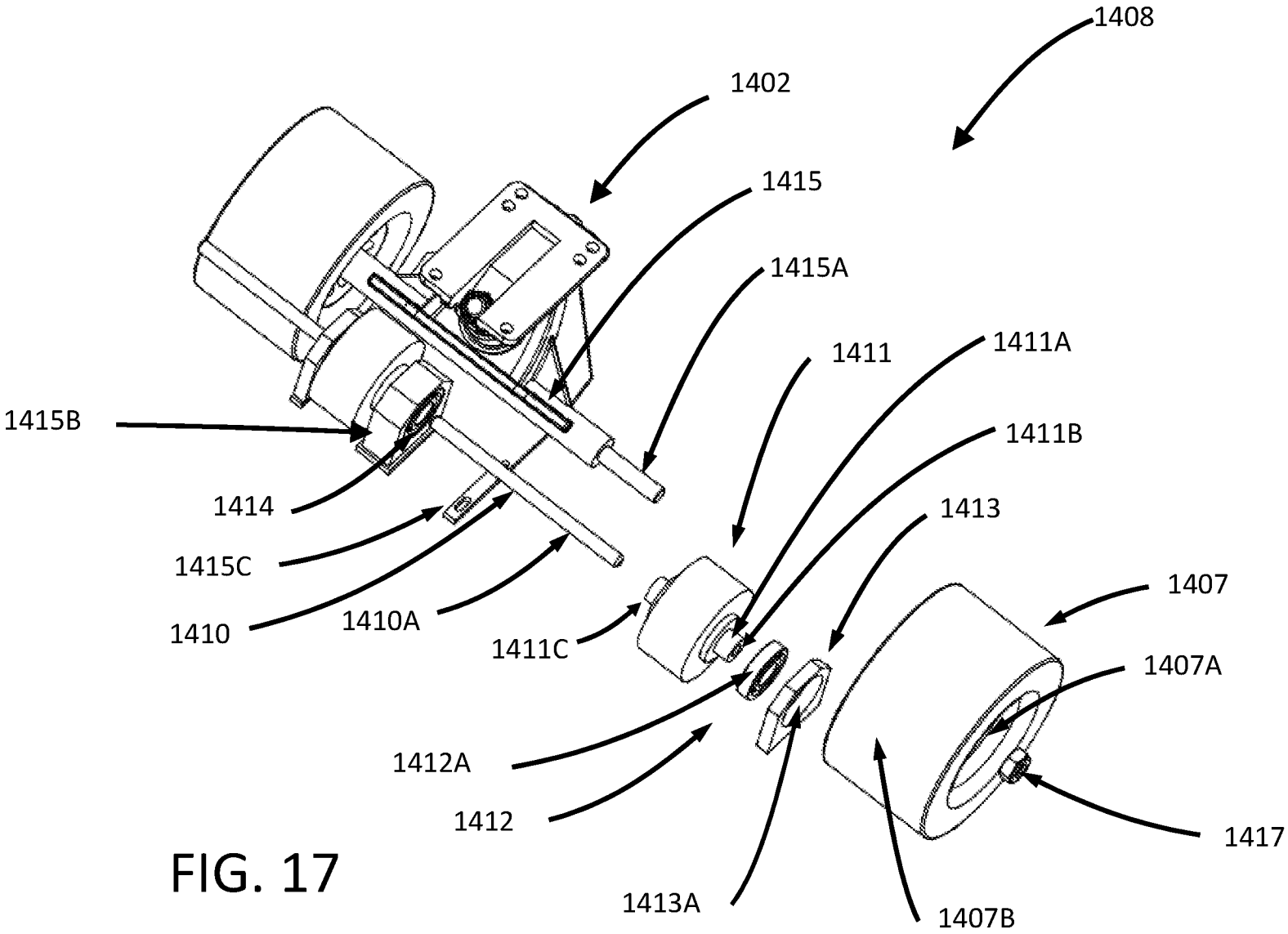
FIG. 17 depicts an exploded isometric of the inertial drive device of the skateboard shown in FIG. 14.

FIG. 17 is a partial exploded view of inertia drive device 1408. Wheel 1407 is attached to hanger 1415 by inserting hanger threaded shaft 1415A into wheel bore 1407A and tightening nut 1417 on the to the end of hanger threaded shaft 1415A. Flywheel shaft 1410 is inserted into flywheel bore 1411B. In this example, flywheel 1411 is supported by first bearing 1414 on flywheel first shoulder 1411C and by second bearing 1412 by flywheel second shoulder 1411A. First bearing 1414 is supported on hanger 1415 by first bearing support feature 1415B. Second bearing 1412 is supported by second bearing support 1413 which is rigidly attached to hanger 1415 at second bearing support attach feature 1415C. Second bearing 1412 is engaged with second bearing support bore 1413A on the periphery 1412A of second bearing 1412. Flywheel shaft contact area 1410A contacts the cylindrical surface 1407B of wheel 1407. This contact is used to drive flywheel shaft 1410 by wheel 1407. In some examples, the flywheel 1411 moves with hanger 1415. Drive support 422 and wheel 407 are supported by axle 418. This causes the flywheel 1411 and wheel 1407 to maintain their relative location to each other.

In this example, flywheel shaft 1410 may be a ¼ inch in diameter and wheel 1407 may be 4 inches in diameter. This combination of diameters results in flywheel 1411 rotating at sixteen (16) times the speed of wheel 1407. In this example, the total inertia at wheel 1407 not including the mass of flywheel shaft 1410 is determined below:

$$I_{total}=I_w+(16)^2\times I_f$$

Where:

$I_{total}$ is the total inertia at wheel 1407 not including the inertia of the flywheel shaft 1410

$I_w$ is the inertia of the wheel 1407

$I_f$ is the inertia of the flywheel 1411

E: Illustrative Bevel Driven Inertia Enhanced Skateboard

Figure 18:
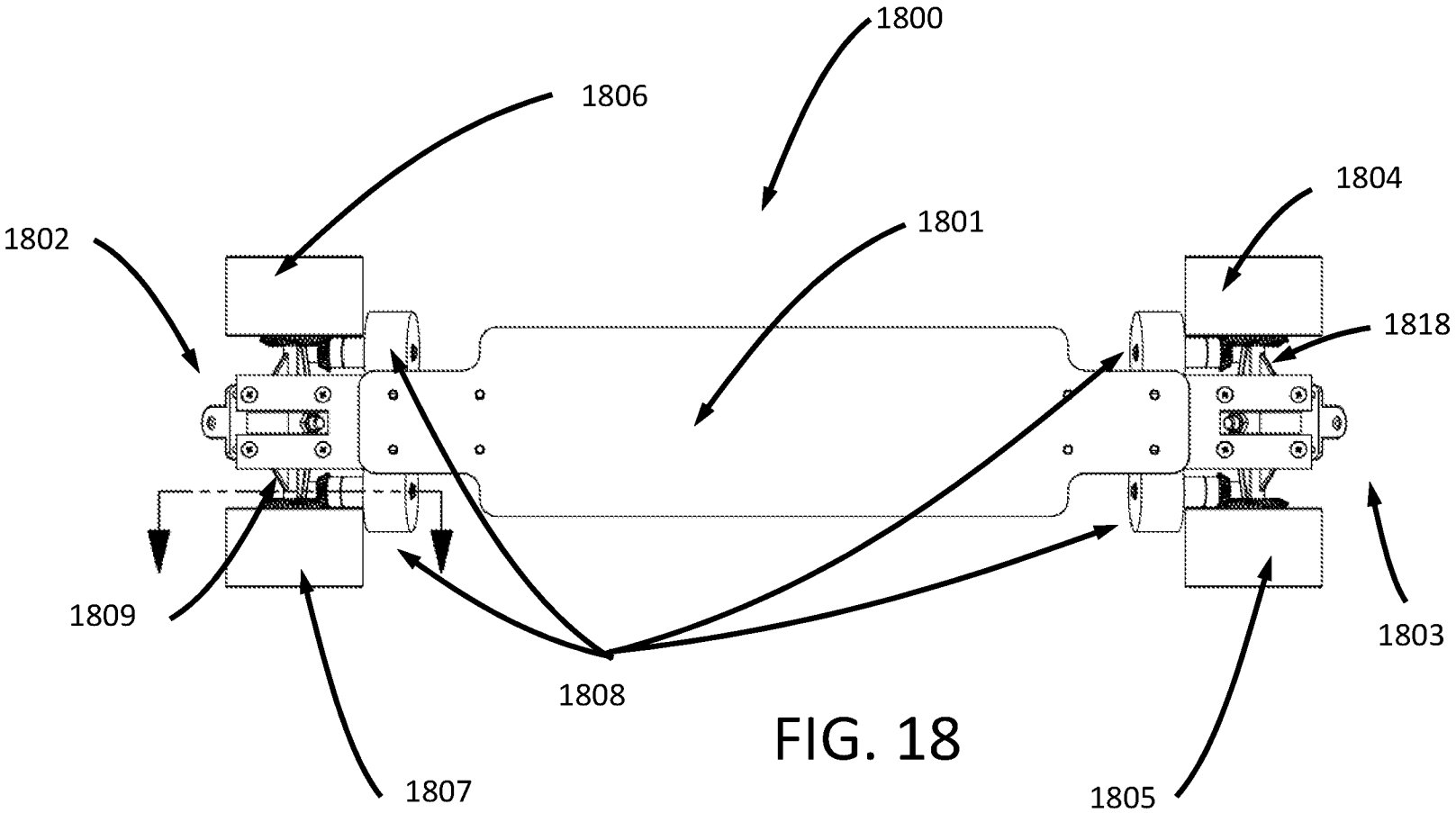
FIG. 18 depicts a top view of an illustrative bevel driven inertia enhanced skateboard.
Figure 19:
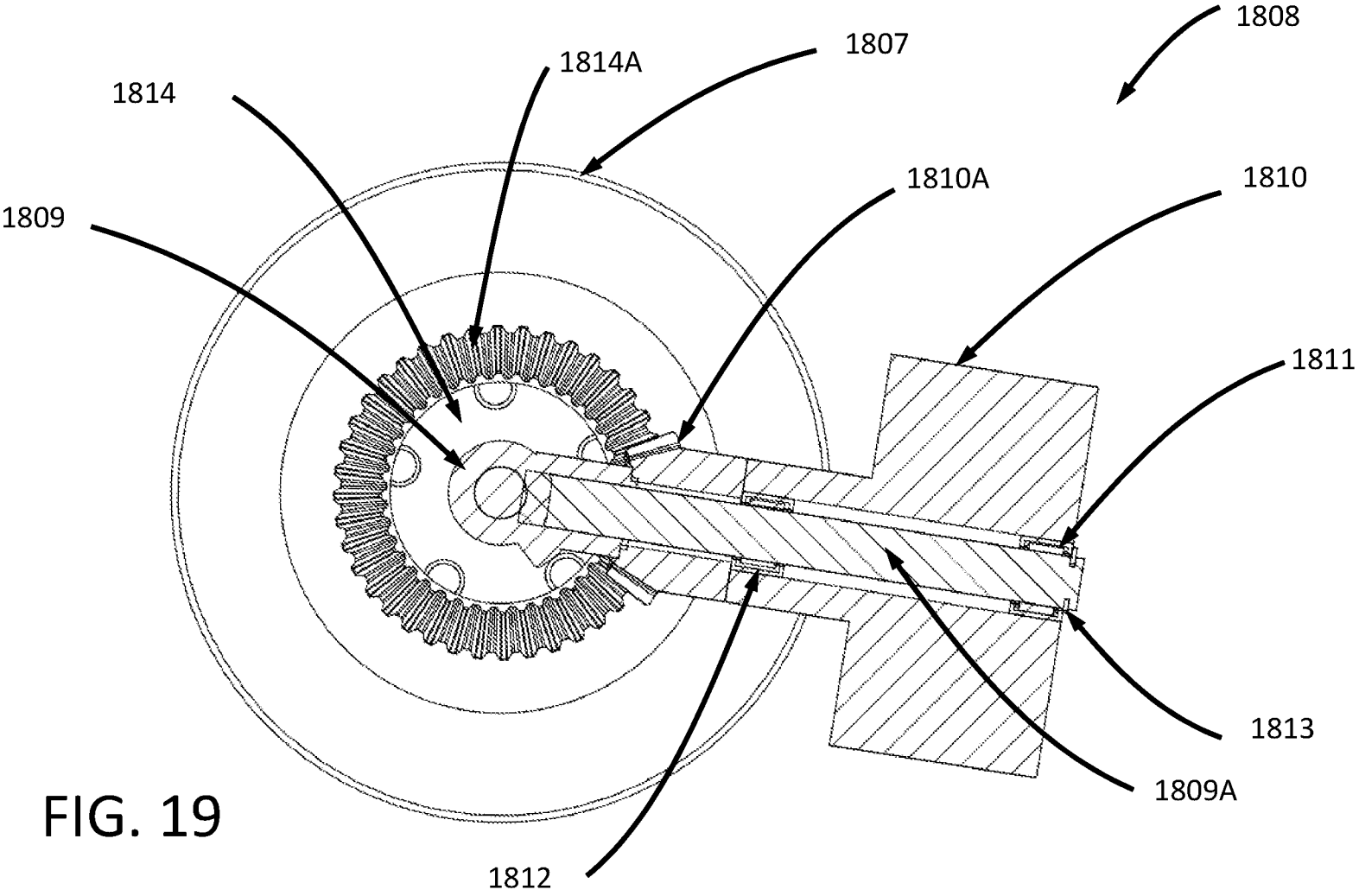
FIG. 19 depicts a cross sectional view shown in FIG. 18.
Figure 20:
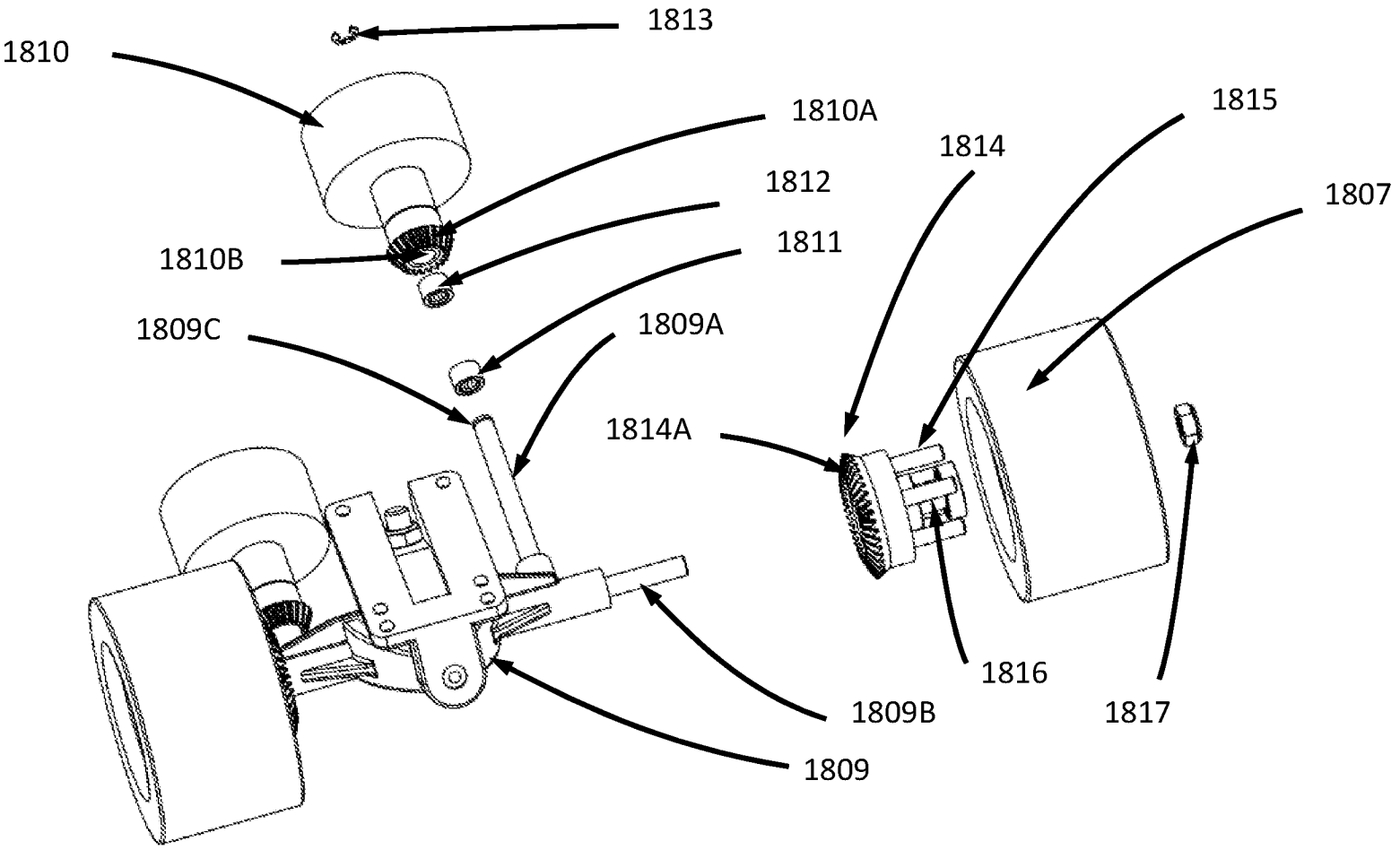
FIG. 20 depicts a partial exploded isometric of the inertial drive device of the skateboard of in FIG. 18.

FIGS. 18-20 depict an illustrative bevel driven inertia enhanced skateboard 1800. Leading truck 1802 and following truck 1803 are located at each end of the board 1801. Tilting the board 1801 causes leading truck 1802 and following truck 1803 to turn hangers 1809 and 1818. This causes wheels 1806 and 1807 of leading truck 1802 and wheels 1804 and 1805 of the following truck 1803 to also turn. In this example, an inertia drive device is operatively coupled to each wheel. Examples of these inertia drive devices 1808 are illustrated in FIGS. 18-20.

Inertia drive device 1808 may include a bevel drive gear 1814 attached to wheel 1807. Wheel 1807 may be supported by a shaft feature 1809B (shown in FIG. 20) located on hanger 1809. In some examples, wheel 1807 is rotationally supported by shaft feature 1809B by bearing 1816. Bevel drive gear 1814 is rigidly attach to wheel 1807 by pins 1816. Rotating wheel 1807 causes bevel drive gear 1814 to rotate. Flywheel 1810 may be supported by flywheel bearings 1811 and 1812 on flywheel shaft feature 1809A located on hanger 1809. In some examples, flywheel 1810 includes bevel teeth 1810A which engage bevel drive gear teeth 1814A. In some examples, bevel drive gear 1814 is attached to wheel 1807 using pins 1815. Any means of rigidly connecting bevel drive gear 1814 is consistent with this example and may include welding, molding, gluing, or forming bevel drive teeth attached to wheel 1807. In this example, wheel 1807 and wheel bearing 1816 are attached to hanger shaft 1809B by nut 1817. Flywheel 1810 is held onto flywheel shaft feature 1809A by retaining ring 1813 inserted into groove 1809C. Flywheel bearings 1811 and 1812 are inserted into flywheel bore 1810B. Flywheel bearings 1811 and 1812 along with the flywheel 1810 are placed onto the flywheel shaft feature 1809A.

In this example, retaining ring 1813 retains the flywheel bevel teeth 1810A in mesh with the bevel drive teeth 1814A. Rotation of wheel 1807 causes flywheel 1810 to rotate.

In some examples, both flywheel 1810 and wheel 1807 are supported by hanger 1809. This causes the flywheel 1810 and wheel 1807 to maintain their relative location to each other.

In this example, flywheel bevel teeth 1810A have 20 teeth and bevel drive gear teeth 1814A have 60 teeth. This combination of meshing teeth results in flywheel 1810 rotating at three (3) times the speed of wheel 1807. In this example, the total inertia at wheel 1807 is determined below:

$$I_{total}=I_w+(3)^2\times I_f$$

Where:

$I_{total}$ is the total inertia at wheel 1807

$I_w$ is the inertia of the wheel 1807

$I_f$ is the inertia of the flywheel 1810

F: Illustrative Inertia Enhanced Two Wheeled Skateboard

Figures 21, 22:
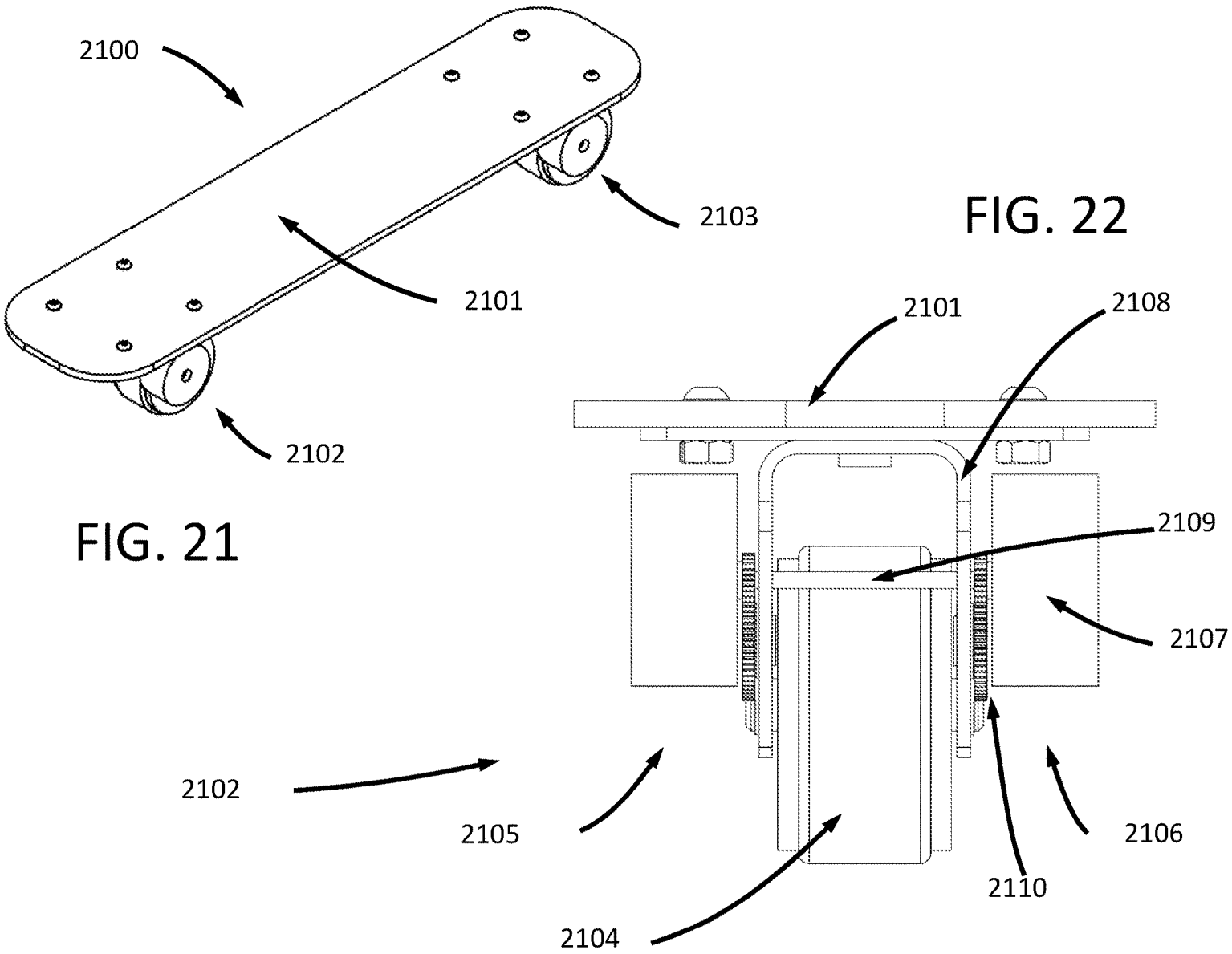
FIG. 21 depicts an isometric view of an illustrative inertia enhanced two wheeled skateboard.
FIG. 22 depicts a front view of the skateboard of FIG. 21.
Figure 23:
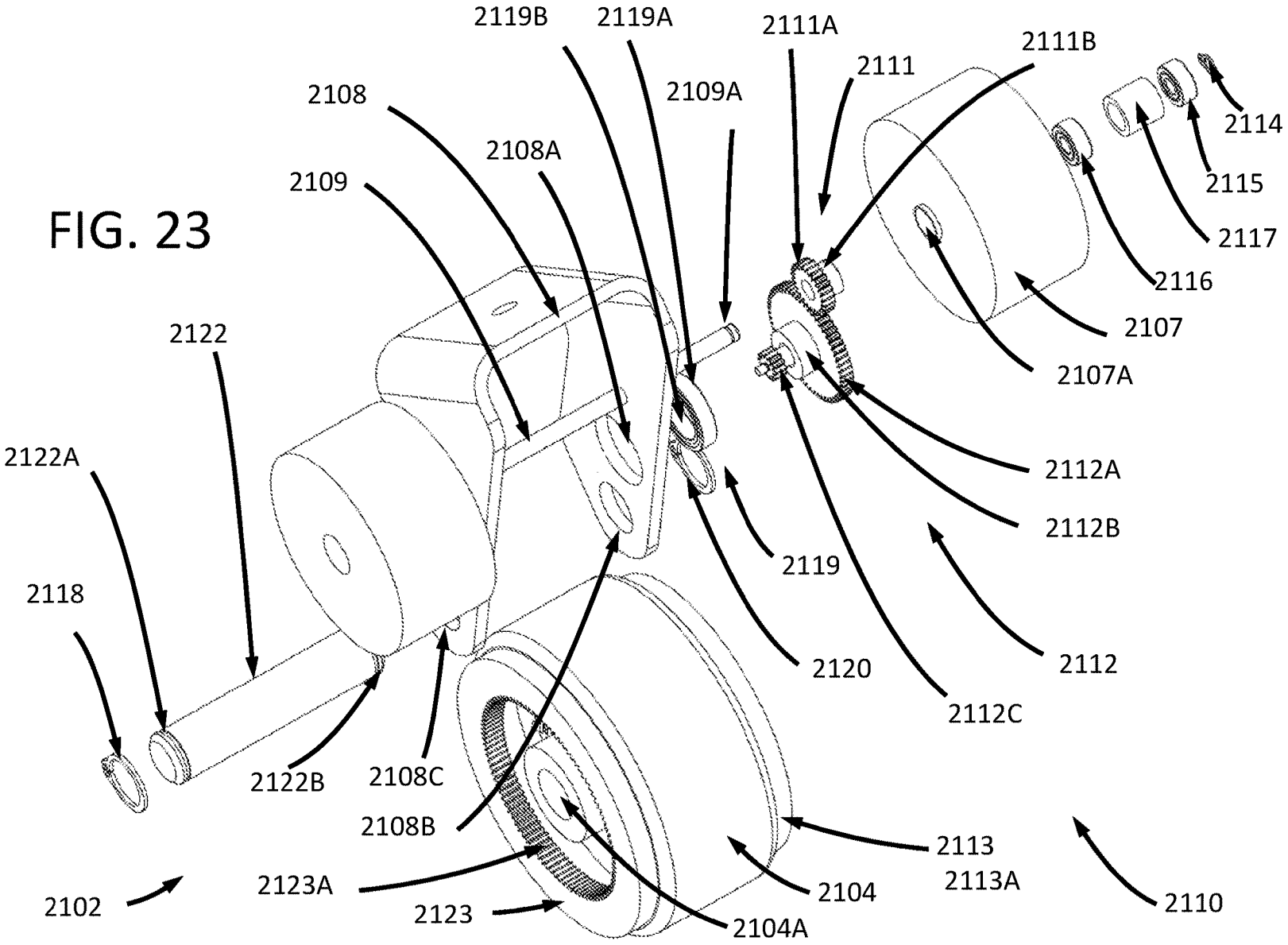
FIG. 23 depicts a partial exploded isometric of the inertial drive device of the skateboard of FIG. 21.

FIGS. 21-23 depict an illustrative inertia enhanced two wheeled skateboard 2100. Attached to board 2101 are leading truck 2102 and following truck 2103. FIG. 22 shows truck 2102 with a wheel 2104 and two inertia drive devices 2105 and 2106 on either side of wheel 2104. Inertia drive devices 2105 and 2106 are represented as similar but this is not a requirement of the example and only a single flywheel drive device need be considered. Inertia drive device 2106 includes flywheel 2107 rotationally attached to flywheel shaft 2109 which is rigidly supported by truck hanger 2108. A gear train 2110 for rotating the flywheel 2107 is included in the flywheel drive device 2106. Gear train 2110 will be explained in more detail below.

FIG. 23 depicts partial exploded isometric view of leading truck 2102. Wheel 2104 has a first ring gear 2113 attached to the side. In this particular example, a second ring gear 2123 is attached to the other side of wheel 2104 and shows second ring gear teeth 2123A. First ring gear 2113 also includes similar first ring gear teeth 2113A (not shown). Wheel shaft 2122 is supported in hanger 2108 on bore 2108B and bore 2108C. Wheel shaft 2122 supports wheel 2104 by engaging wheel bore 2104A. Wheel shaft 2122 is held in place by retaining rings 2118 and 2120 by inserting these retaining rings into grooves 2122A and 2122B located on wheel shaft 2122.

Cluster gear bearing 2119 is supported on the periphery cylindrical surface 2119A on the hanger 2108 at bore 2108A. The cluster gear bearing bore 2108A supports the cluster gear 2112 on the cluster gear shoulder 2112B. Cluster gear input teeth 2112C mesh with the first ring gear teeth 2113A, this meshing allows the wheel 2104 to rotate the cluster gear 2112 as wheel 2104 rotates. Cluster gear output teeth 2112A mesh with flywheel teeth 2111A of the flywheel gear 2111.

Flywheel gear 2111 is rigidly attached to flywheel 2107 by a press fit of flywheel gear shoulder 2111B with flywheel bore 2107A. Flywheel 2107 is rotationally supported by bearings 2116 and 2115 which are pressed into flywheel bore 2107A opposite the flywheel gear 2111. Spacer 2117 positions bearings 2116 and 2115. Bearings 2116 and 2115 are supported by hanger shaft 2109 and are restrained from sliding on hanger shaft 2109 by retaining ring 2114 that is positioned into groove 2109A of the hanger shaft 2109.

In some examples, both flywheel 2107 and wheel 2104 are supported by hanger 2108. This causes the flywheel 2107 and wheel 2104 to maintain their relative location to each other.

In this example, ring gear teeth 2113A include 100 teeth, input cluster gear teeth 2112C include 20 teeth, output cluster gear teeth 2112A include 56 teeth, and flywheel gear teeth 2111A include 24 teeth. This combination of meshing teeth results in flywheel 2107 rotating at 11.66 times the speed of wheel 2104. In this example, the total inertia at wheel 2104 is determined below:

$$I_{total}=I_w+2\times(11.66)^2\times I_f$$

Where:

$I_{total}$ is the total inertia at wheel 2104

$I_w$ is the inertia of the wheel 2104

$I_f$ is the inertia of the flywheel 2107

G: Illustrative Inertia Enhanced Two Wheeled Skateboard with Friction Drive

Figure 24:
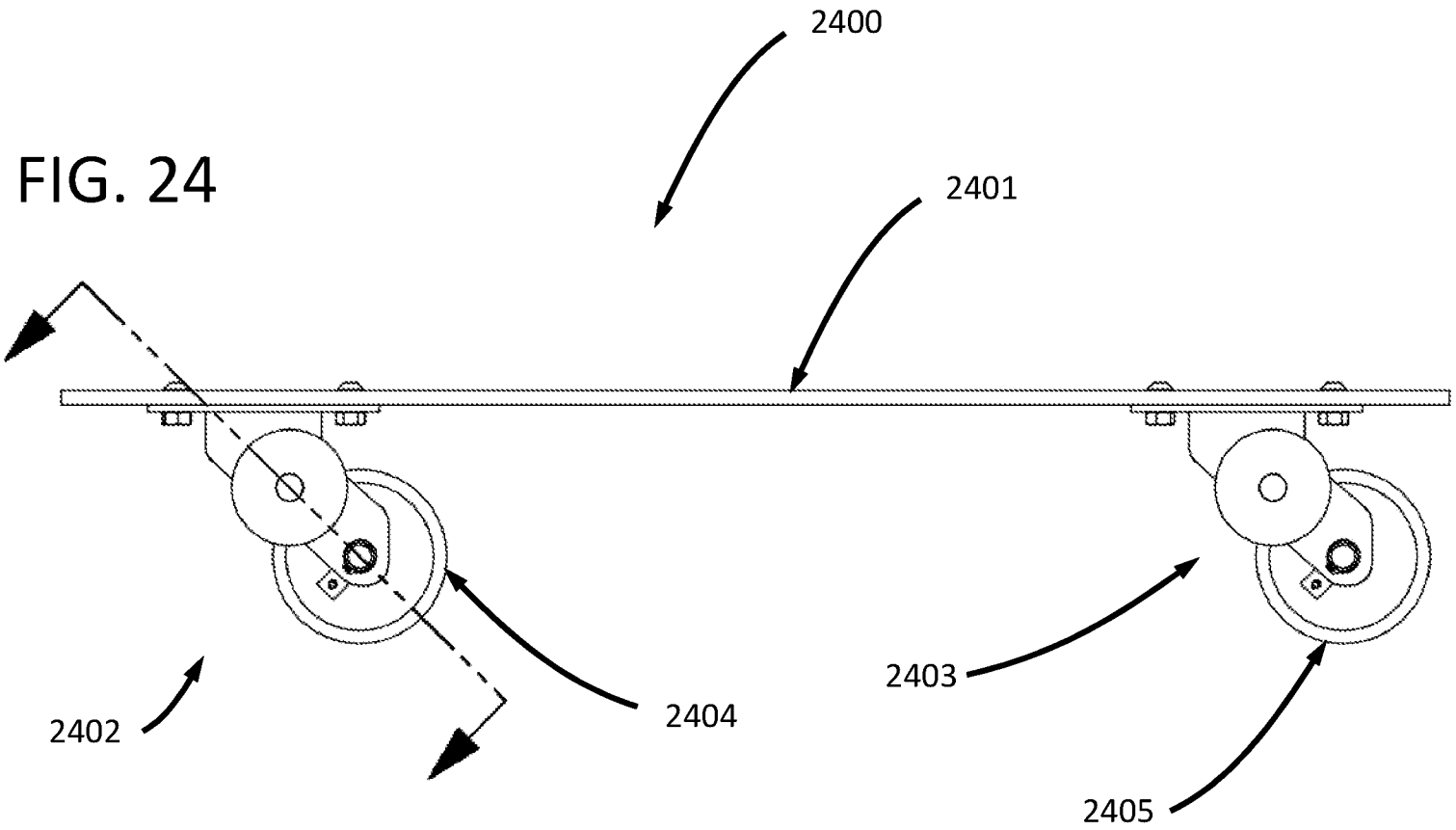
FIG. 24 depicts a side view of an illustrative inertia enhanced two wheeled skateboard with friction drive.
Figure 25:
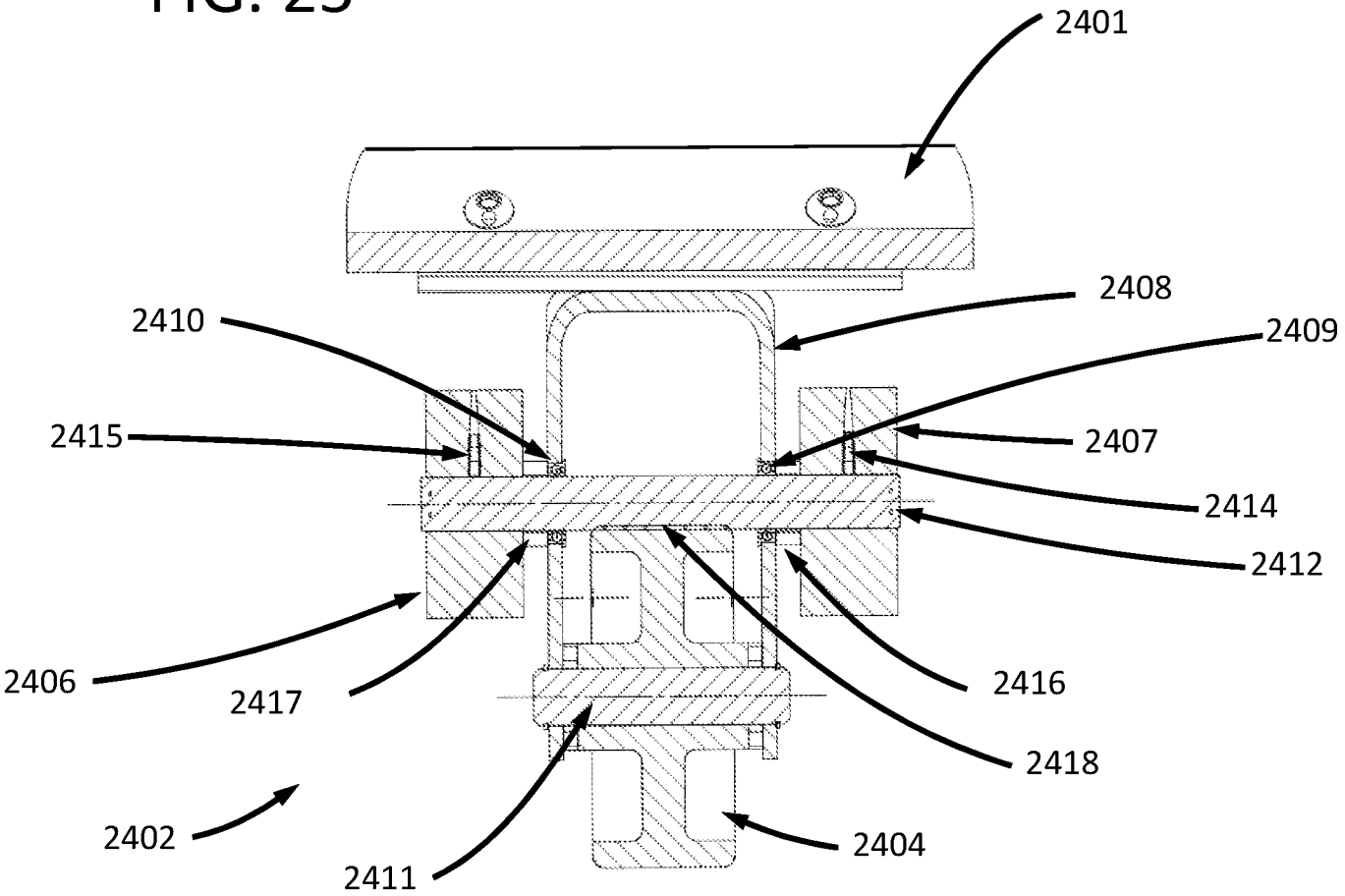
FIG. 25 depicts the cross section of FIG. 24.
Figure 26:
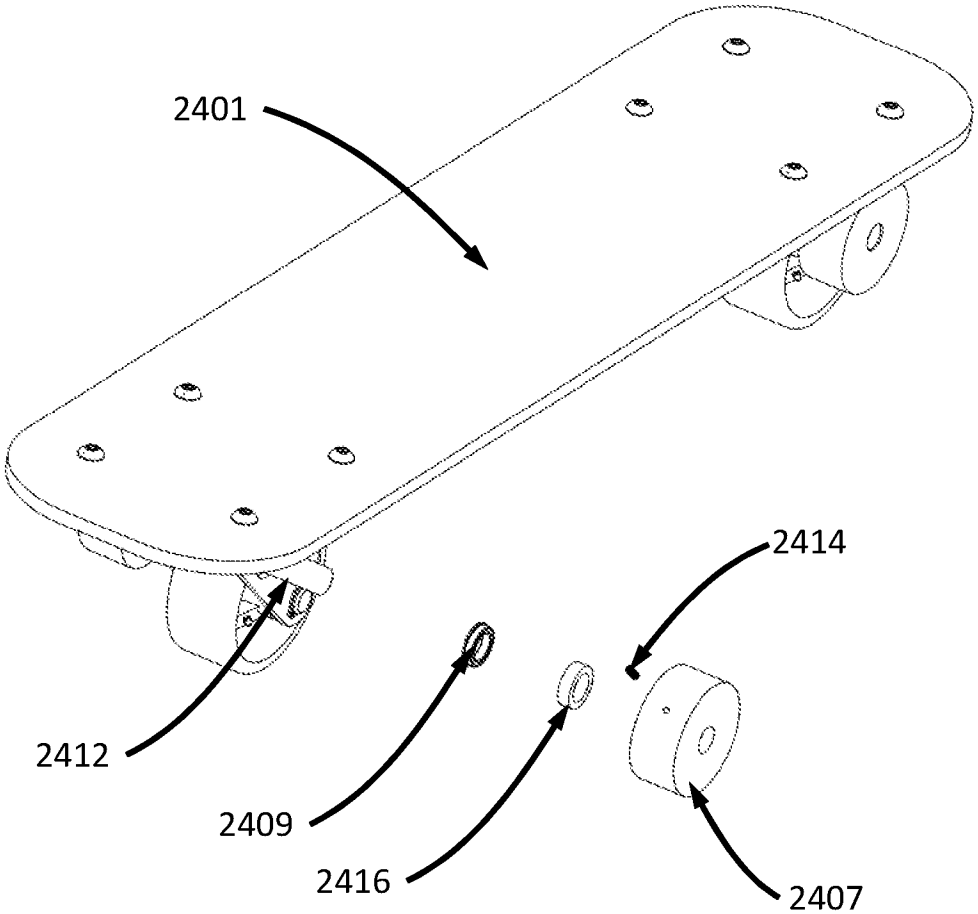
FIG. 26 depicts a partial exploded isometric of the inertial drive device of FIG. 24.

FIGS. 24-26 depict an illustrative inertia enhanced two wheeled skateboard 2400. Attached to board 2401 are leading truck 2402 and following truck 2403. FIG. 25 depicts the cross section shown in FIG. 24 truck 2402 with a wheel 2404 and two flywheels 2406 and 2407 on either side of wheel 2404. Flywheels 2406 and 2407 are represented as similar but this is not a requirement of the example and only a single flywheel need be used.

Hanger 2408 supports wheel 2404 and flywheel 2407 and 2406. Bearings 2409 and 2410 are attached to hanger 2408 and support flywheel shaft 2412. On each end of flywheel shaft 2412 are flywheels 2406 and 2407. Each flywheel is secured to flywheel shaft 2412 by set screws 2414 and 2415. Spacers 2416 and 2417 provide clearance between flywheels 2406 and 2407 and hanger 2408.

In order to drive flywheel shaft 2412 contact area 2418 contacts both the flywheel shaft 2412 and wheel 2404. Friction between flywheel shaft 2412 and wheel 2404 causes contact area 2418 to transmit energy between wheel 2404 and flywheel shaft 2412. Contact area 2418 may include features such as knurling and/or coatings on both flywheel shaft 2412 and wheel 2404. In this example, flywheel 2404, flywheel shaft 2412, wheel 2404, and contact area 2418 act as a inertia drive device.

FIG. 26 is a partial exploded isometric of flywheel 2407 mounting, and is included for clarity.

In some examples, both flywheels 2406, 2407, and wheel 2404 are supported by hanger 2408. This causes the flywheels 2406, 2407, and wheel 2404 to maintain their relative location to each other.

In this example, flywheel shaft 2412 is ½ inches in diameter and wheel 2404 is 2 inches in diameter. This combination of diameters causes flywheel 2407 to rotate 4 times the speed of wheel 2404. In this example, the total inertia at wheel 2104 is determined below:

$$I_{total}=I_w+2\times(4)^2\times I_f$$

Where:

$I_{total}$ is the total inertia at wheel 2404

$I_w$ is the inertia of the wheel 2404

$I_f$ is the inertia of the flywheel 2407

H: Illustrative Inertia Enhanced Skateboard Having Single Steering Truck

Figure 27:
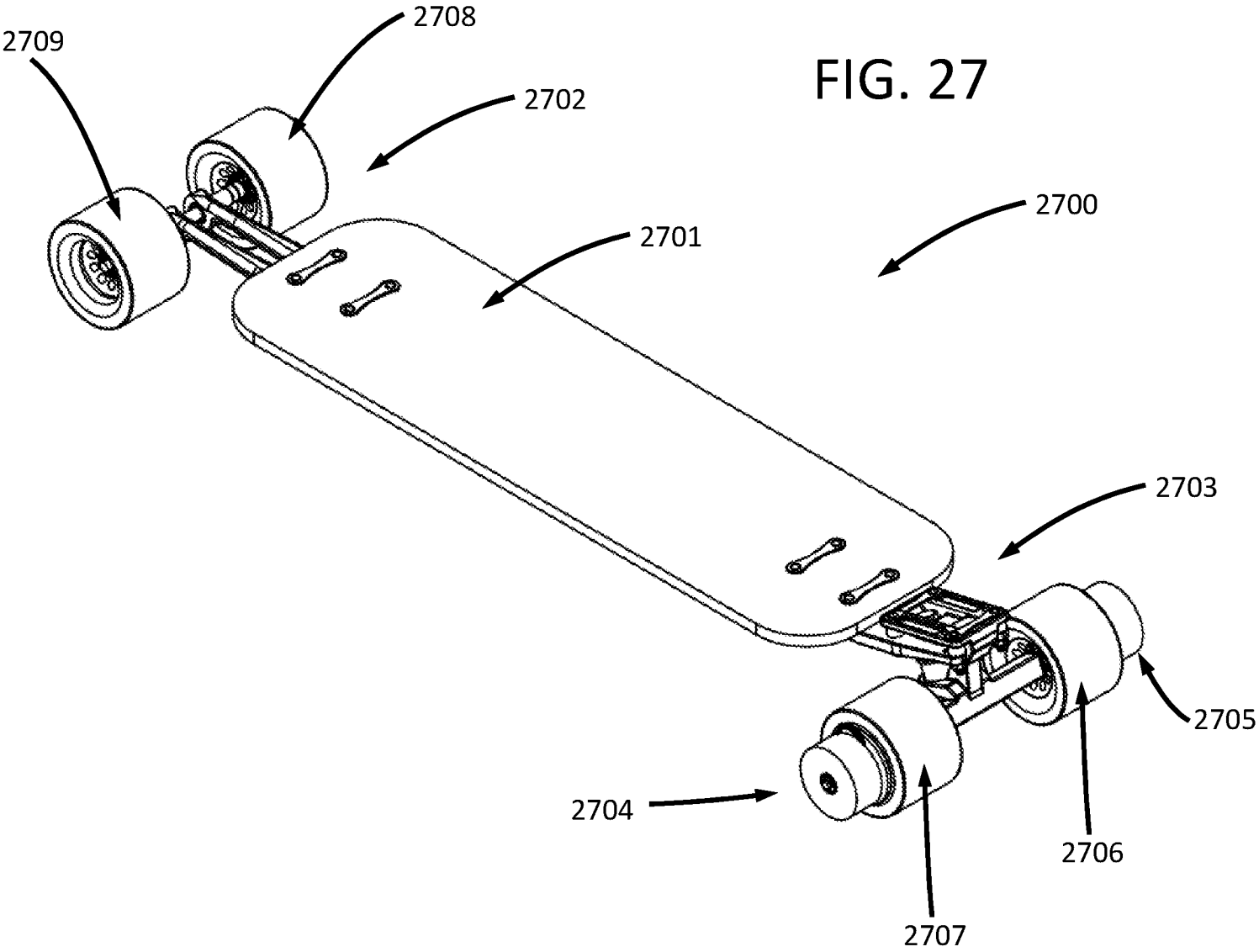
FIG. 27 depicts an isometric view of an illustrative inertia enhanced skateboard having single steering truck.
Figure 28:
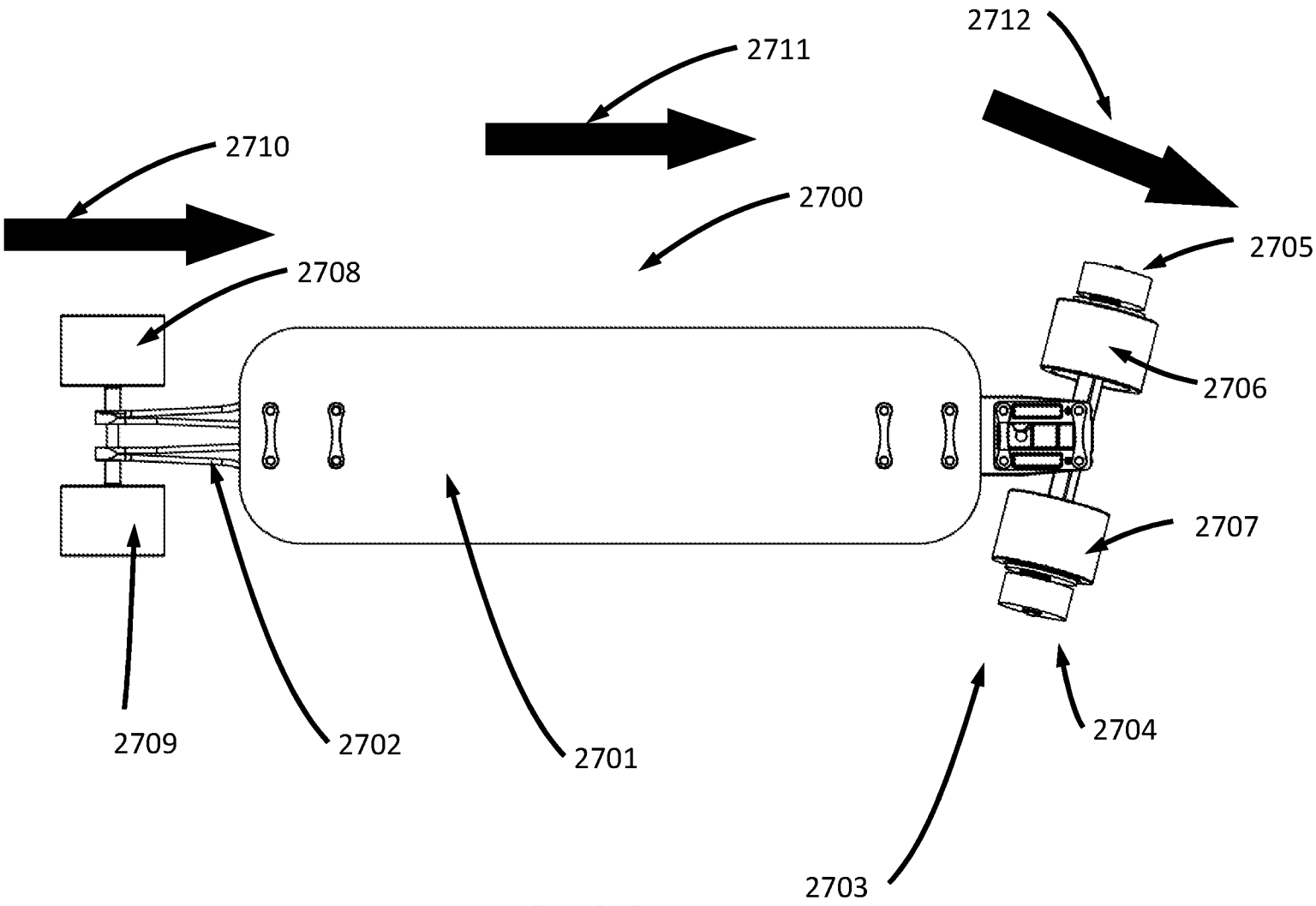
FIG. 28 depicts a top view of a turning illustrative inertia enhanced skateboard having single steering truck.

FIGS. 27 and 28 depict an illustrative inertia enhanced skateboard 2700. This example includes leading truck 2703 which turns wheels 2707 and 2706 in response to tilting board 2701. In this example, following truck 2702 allows board 2701 to tilt but does not allow following wheels 2708 and 2709 to turn.

Leading truck 2703 includes inertia drive devices 2704 and 2705 which include flywheels that are driven by the wheels 2706 and 2707. Inertia drive devices 2704 and 2405 cause flywheels to rotate at a higher speed than wheels 2706 and 2707.

FIG. 28 shows skateboard 2700 turning. Tilting board 2701 causes the leading truck 2703 to turn wheels 2706 and 2707 in the direction of arrow 2712 while the board 2701 and following truck 2702 continue to travel in direction 2710 and 2711. The difference in direction causes wheels 2706 and 2707 to accelerate. Tilting board 2701 back to horizontal causes wheels 2706 and 2707 to travel in direction 2711. Since wheels 2706 and 2707 are rotating faster due to the difference in direction, wheels 2706 and 2707 tend to pull the board forward. Inertia drive devices 2704 and 2705 enhance the pulling effect as they provide inertia to wheels 2707 and 2706. In some examples, inertia drive devices 2704 and 2705 may be similar to any of the inertia drive devices discussed herein.

I: Illustrative Inertia Enhanced Skateboard Having No Flywheel Drive

Figure 29:
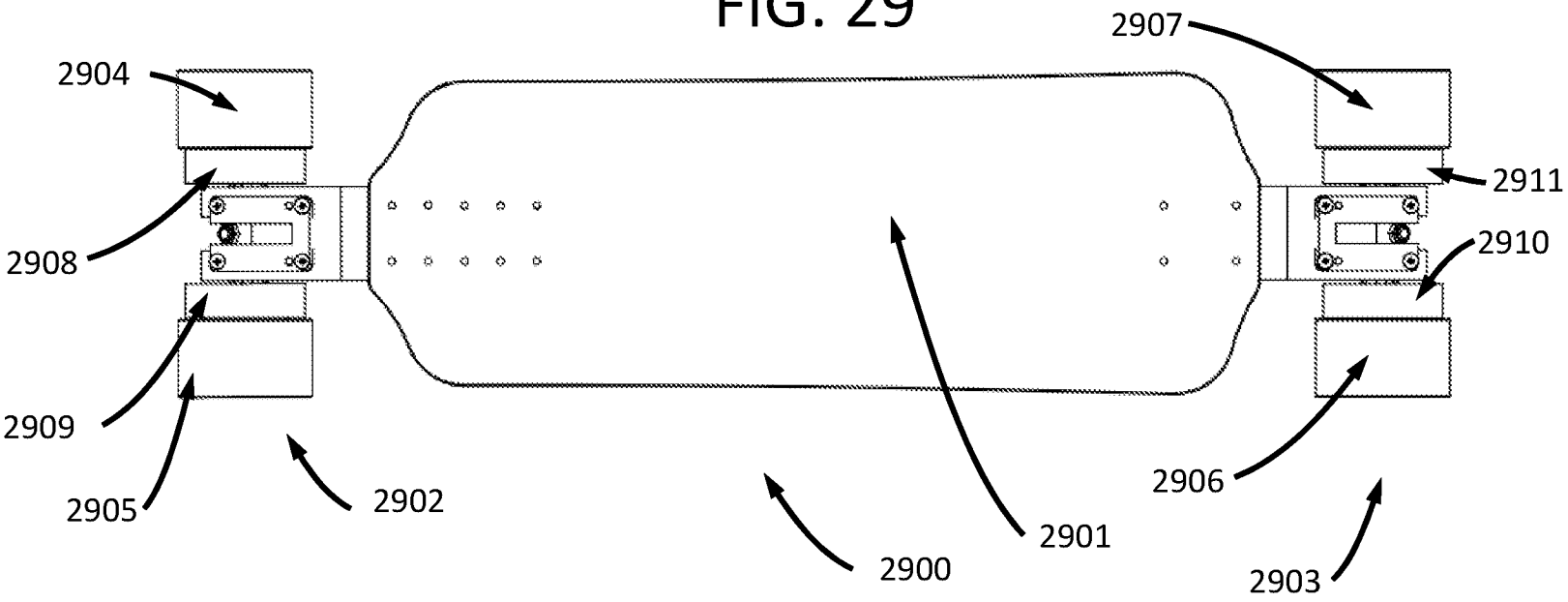
FIG. 29 depicts a top view of an illustrative inertia enhanced skateboard having no flywheel drive.
Figure 30:
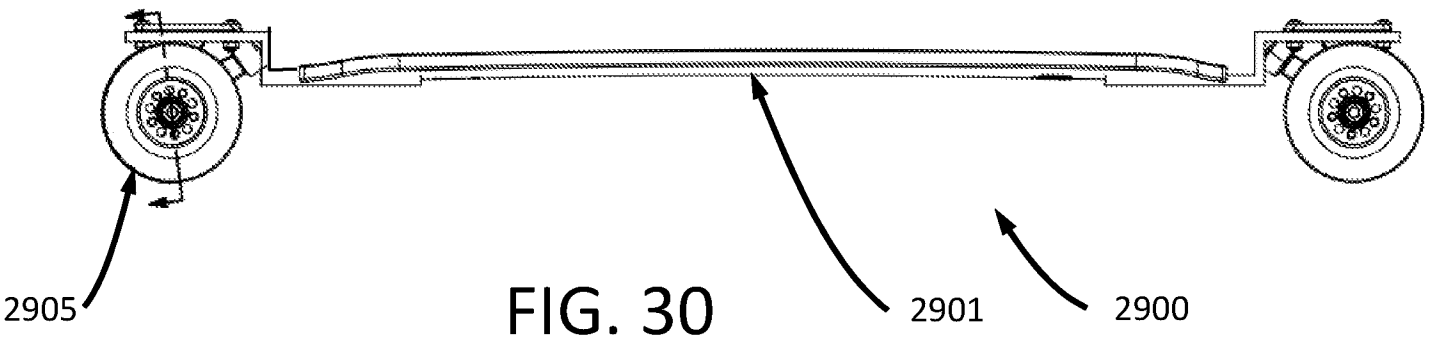
FIG. 30 depicts a side view of the skateboard of FIG. 29.
Figure 31:
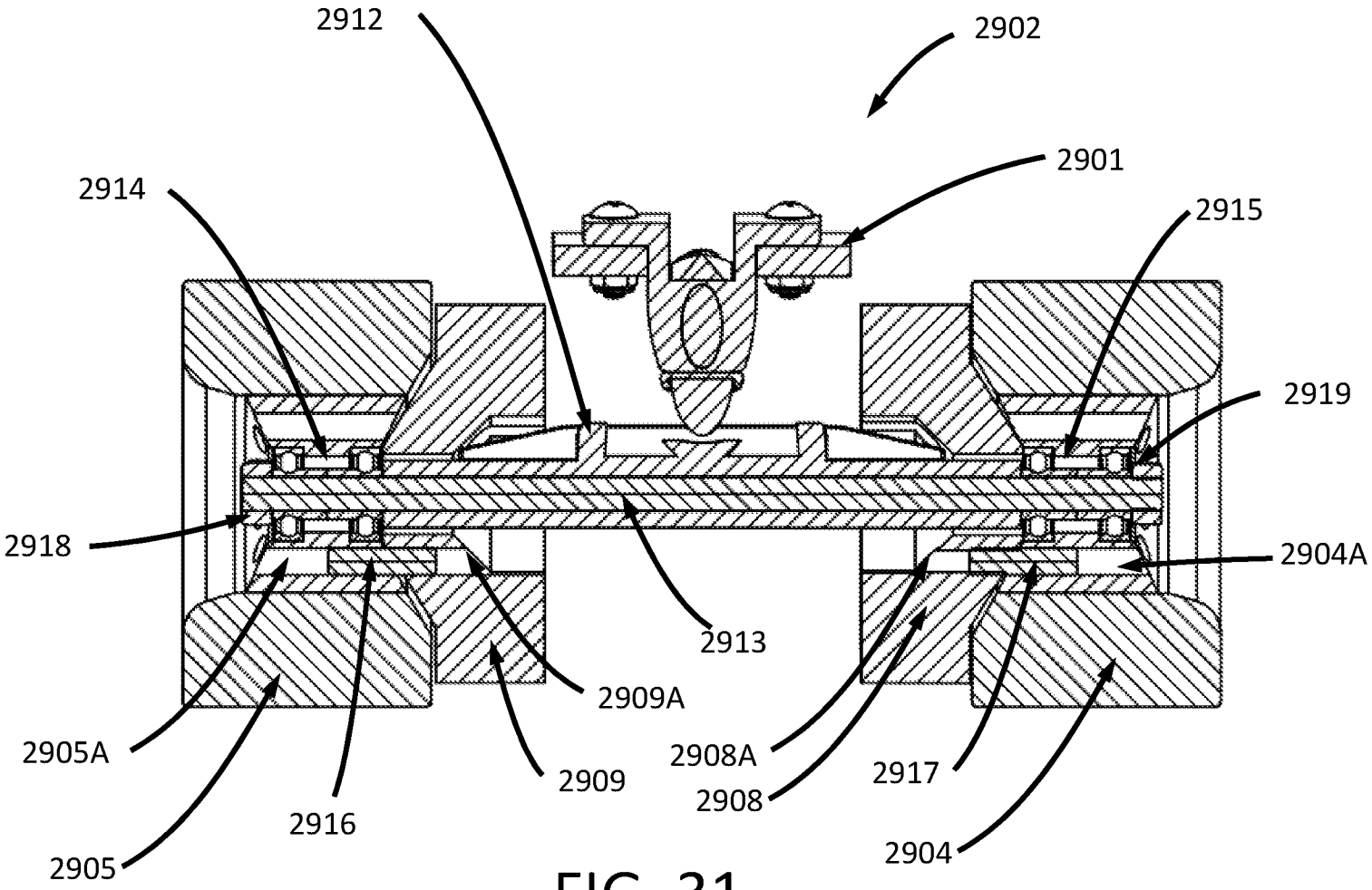
FIG. 31 depicts the section view of FIG. 30.

FIGS. 29, 30, and 31 depict an illustrative inertia enhanced skateboard 2900. This example includes leading truck 2902 which turns wheels 2905 and 2904, and trailing truck 2903 which turns wheels 2906 and 2907 in response to tilting board 2901.

FIG. 30 depicts a side view of an illustrative inertia enhanced skateboard and shows the location of section view FIG. 31.

Leading truck 2902 includes hanger 2912 which is attached to board 2901. Axle 2913 is rigidly supported inside a bore on hanger 2912. Bearing sets 2914 and 2915 support wheels 2905 and 2904 on each end of axle 2913. Each end of axle 2913 is threaded to allow nuts 2918 and 2919 to be screwed on and so retain the bearing sets 2914 and 2915. Pins 2916 and 2917 are pressed into mounting holes 2904A and 2905A located on wheels 2904 and 2905 respectively. These pins 2916 and 2917 are also inserted into holes 2909A of flywheel 2909 and 2908A of flywheel 2908.

In this example, the flywheels 2908 and 2909 rotate at the same speed as wheels 2904 and 2905. In this example, the total inertia at wheel 2905 is determined below:

$$I_{total}=I_w+(1)^2\times I_f$$

Where:

$I_{total}$ is the total inertia at wheel 2905

$I_w$ is the inertia of the wheel 2905

$I_f$ is the inertia of the flywheel 2909

In this example the speed difference is zero and so only the weight of the wheel 2905 and flywheel 2909 provide inertia for stabilization and to enhance "pumping". In this example, only the weight of flywheel 2909 can be used to increase the inertia at wheel 2905. Since leading truck 2902 and following truck 2903 have limited space for a flywheel, the inertia is limited.

In this example the total inertia is limited to the size of the flywheel only. In most skateboards the space for a flywheel is limited. This limitation also limits the inertia of the wheels by adding an inertia drive device the inertia can be fine tuned based on operator preference.

J: Illustrative Inertia Enhanced Skateboard Adjustment Method.

The amount of inertia at each wheel can be adjusted based on the inertia drive device. For example, if an operator wants to increase the stability of the skateboard the inertia drive assembly ratio is increased. This adds inertia to the wheel and helps to maintain the direction and speed of the wheel. The wheel will tend to maintain its direction as imperfections on the ground encounter the wheel.

An operator wanting a specific tradeoff between "pumping" enhancement and "kicking" enhancement may adjust the inertia drive device by increasing or decreasing the inertia drive device ratio. For instance, an operator needing a strong response to "pumping" can get the desired effect by increasing the inertia drive device ratio (e.g. R). An operator needing a strong "kicking" effect can get the desired effect by decreasing the inertia drive device ratio (e.g.R).

Advantages, Features, and Benefits

The different embodiments and examples of the inertia enhanced skateboard described herein provide several advantages over known solutions for providing comfort, control and other operating characteristics. For examples, illustrative embodiments and examples described herein allow for a greater propulsion response during "pumping" without greatly increasing the skateboard weight.

Additionally, and among other benefits, illustrative embodiments and examples described herein allow an increase in stability at higher speeds. The increased inertia of each wheel tends to maintain the direction of each wheel. This is similar to a bicycle being easier to balance depending on the size of the wheels.

Additionally, and among other benefits, illustrative embodiments and examples described herein allow a balancing component for skateboards with single wheel trucks.

Additionally, and among other benefits, illustrative embodiments and examples described herein allow the inertia drive device to be located relative a wheel is in a fixed location. This allows the inertia mass to be located in a fixed location relative to the wheel. The inertia drive device and the wheel easily transfer energy to each with mechanical devices such as couplings to allow for relative movement.

No known system or device can perform these functions. However, not all embodiments and examples described herein provide the same advantages or the same degree of advantage.

Conclusion

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

I claim:

1. A skateboard truck comprising;

a hanger, a wheel having a first rotational axis and a periphery rotationally attached to the hanger, an inertial mass having a second rotational axis rotationally attached to the hanger, a drive device attached to the hanger configured to rotate the inertial mass at a greater rotational speed than the wheel.

2. The skateboard truck of claim 1, wherein the first rotational axis and the second rotational axis are collinear.

3. The skateboard truck of claim 1, wherein the first rotational axis and the second rotational axis are parallel.

4. The skateboard truck of claim 1, wherein the first rotational axis and the second rotational axis are perpendicular.

5. The skateboard truck of claim 1, where in the drive device includes;

a shaft having a third rotational axis positioned parallel to the first rotational axis, and configured to contact the wheel and further configured to rotate the inertial mass.

6. The skateboard truck of claim 5, wherein the shaft is round and is smaller in diameter than the wheel, and is further configured to contact the periphery of the wheel, and the second rotational axis is collinear with the third rotational axis, the inertia mass being operatively attached to the shaft and configured to rotate about the third rotational axis.

7. The skateboard truck of claim 1, wherein the drive device includes;

a first gear operatively attached to the wheel, and a second gear configured to provide torque to the inertial mass.

8. The skateboard truck of claim 1, wherein the drive device comprises;

a first pulley operatively attached to the wheel, a second pulley operatively attached to the inertial mass, and a belt configured to provide torque between the first pulley to the second pulley.

9. The skateboard truck of claim 8, wherein the first pulley is rigidly attached to the wheel.

10. The skateboard truck of claim 8, wherein the second pulley is rigidly attached to the inertial mass.

11. The skateboard truck of claim 9, wherein the second pulley is rigidly attached to the inertial mass.

12. The skateboard truck of claim 1, wherein the drive device is outboard of the wheel.

13. The skateboard truck of claim 1, wherein the drive device is inboard of the wheel.

14. The skateboard truck of claim 1, wherein the drive device is rearward of the wheel.

15. The skateboard truck of claim 1, wherein the drive device is forward of the wheel.

16. A method of adjusting the wheel inertia of a skateboard truck, wherein the skateboard includes;

a wheel having a first rotational axis and a periphery, an inertial mass having mass and a second rotational axis configured to transfer torque to the wheel, and a drive device configured to rotate the inertial mass at a greater rotational speed than the wheel, comprising;

adjusting the rotational speed of the inertial mass, and pumping the skateboard truck to get a desired response from the skateboard truck.

17. The method of claim 16 further comprising;

adjusting the mass of the inertial mass.

18. A skateboard comprising;

a hanger, a wheel rotationally supported on the hanger, an inertial mass rotationally supported on the hanger, and a drive device supported on the hanger configured to rotate the inertial mass at a speed greater than wheel speed and further configured to stabilize the skateboard.

19. The skateboard of claim 18 wherein, the wheel rotates around a first axis and the inertia mass rotates around a second axis, and first and second axis are parallel.

20. The skateboard of claim 18 wherein, the wheel rotates around a first axis and the inertia mass rotates around a second axis, and first and second axes are perpendicular.

* * * * *